US011054773B2

(12) United States Patent
Furuichi et al.

(10) Patent No.: US 11,054,773 B2
(45) Date of Patent: Jul. 6, 2021

(54) HEATER, HEATING DEVICE, FIXING DEVICE, AND IMAGE FORMING APPARATUS

(71) Applicants: Yuusuke Furuichi, Kanagawa (JP); Kenji Ishii, Kanagawa (JP); Kenichi Hasegawa, Kanagawa (JP); Takashi Fujita, Kanagawa (JP); Tomoya Adachi, Kanagawa (JP); Yukimichi Someya, Kanagawa (JP); Daisuke Inoue, Tokyo (JP); Masahiro Samei, Kanagawa (JP); Takayuki Seki, Kanagawa (JP)

(72) Inventors: Yuusuke Furuichi, Kanagawa (JP); Kenji Ishii, Kanagawa (JP); Kenichi Hasegawa, Kanagawa (JP); Takashi Fujita, Kanagawa (JP); Tomoya Adachi, Kanagawa (JP); Yukimichi Someya, Kanagawa (JP); Daisuke Inoue, Tokyo (JP); Masahiro Samei, Kanagawa (JP); Takayuki Seki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/784,475

(22) Filed: Feb. 7, 2020

(65) Prior Publication Data

US 2020/0292973 A1 Sep. 17, 2020

(30) Foreign Application Priority Data

Mar. 14, 2019 (JP) ..... JP2019-047202

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2053; G03G 2215/2003; G03G 2215/2035
See application file for complete search history.

(56) References Cited

U.S. PATENT DOCUMENTS

2012/0230742 A1* 9/2012 Nakagawa ..... G03G 15/2057 399/329
2014/0186079 A1* 7/2014 Morita ..... G03G 15/2053 399/329
2014/0341621 A1* 11/2014 Omori ..... G03G 15/2028 399/329
2017/0146934 A1* 5/2017 Kaji ..... G03G 15/205
2017/0176906 A1 6/2017 Sawada et al.
2017/0176907 A1 6/2017 Sawada et al.
(Continued)

FOREIGN PATENT DOCUMENTS

JP 2004-198448 7/2004

*Primary Examiner* — Thomas S Giampaolo, II
(74) *Attorney, Agent, or Firm* — Oblon, McClelland, Maier & Neustadt, L.L.P.

(57) ABSTRACT

A heater includes a base layer, a heat generator mounted on the base layer, and a slide layer mounted on the base layer. A sliding face of a counterpart slides over the slide layer. The slide layer is made of a material containing fluorine and includes a slide face that contacts the sliding face of the counterpart. The slide face of the slide layer has a surface roughness that is greater than a surface roughness of the sliding face of the counterpart.

20 Claims, 12 Drawing Sheets

(56) References Cited

U.S. PATENT DOCUMENTS

| | | | | |
|---|---|---|---|---|
| 2017/0185015 | A1 | 6/2017 | Yoshinaga et al. | |
| 2017/0185020 | A1 | 6/2017 | Seki et al. | |
| 2017/0255147 | A1 | 9/2017 | Seki et al. | |
| 2017/0261900 | A1 | 9/2017 | Sawada et al. | |
| 2017/0293245 | A1 | 10/2017 | Kawata et al. | |
| 2018/0011432 | A1 | 1/2018 | Yoshinaga et al. | |
| 2018/0011434 | A1 | 1/2018 | Adachi | |
| 2018/0032008 | A1* | 2/2018 | Sako | G03G 15/80 |
| 2018/0059587 | A1 | 3/2018 | Sawada et al. | |
| 2018/0157198 | A1 | 6/2018 | Seto et al. | |
| 2018/0173138 | A1 | 6/2018 | Seki et al. | |
| 2018/0203384 | A1 | 7/2018 | Okamoto et al. | |
| 2018/0335733 | A1 | 11/2018 | Matsuda | |
| 2018/0356754 | A1 | 12/2018 | Yoshinaga et al. | |
| 2019/0286026 | A1 | 9/2019 | Furuichi et al. | |
| 2019/0286028 | A1 | 9/2019 | Furuichi et al. | |
| 2020/0033768 | A1 | 1/2020 | Furuichi et al. | |
| 2020/0393782 | A1* | 12/2020 | Nakamura | G03G 15/2025 |

* cited by examiner

HEATER, HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-047202, filed on Mar. 14, 2019, in the Japan Patent Office, the entire disclosure of which is hereby incorporated by reference herein.

BACKGROUND

Technical Field

Exemplary aspects of the present disclosure relate to a heater, a heating device, a fixing device, and an image forming apparatus, and more particularly, to a heater, a heating device incorporating the heater, a fixing device incorporating the heater, and an image forming apparatus incorporating the heater.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device that fixes a toner image on a sheet serving as a recording medium under heat or a dryer that dries ink on a sheet. The fixing device and the dryer employ a heater including a platy base layer and a resistive heat generator serving as a heat generator disposed on the base layer.

SUMMARY

This specification describes below an improved heater. In one embodiment, the heater includes a base layer, a heat generator mounted on the base layer, and a slide layer mounted on the base layer. A sliding face of a counterpart slides over the slide layer. The slide layer is made of a material containing fluorine and includes a slide face that contacts the sliding face of the counterpart. The slide face of the slide layer has a surface roughness that is greater than a surface roughness of the sliding face of the counterpart.

This specification further describes an improved heating device. In one embodiment, the heating device includes a counterpart that includes a sliding face and a heater that heats the counterpart. The heater includes a base layer, a heat generator mounted on the base layer, and a slide layer mounted on the base layer. The sliding face of the counterpart slides over the slide layer. The slide layer is made of a material containing fluorine and includes a slide face that contacts the sliding face of the counterpart. The slide face has a surface roughness that is greater than a surface roughness of the sliding face of the counterpart.

This specification further describes an improved fixing device. In one embodiment, the fixing device includes the heater described above.

This specification further describes an improved image forming apparatus. In one embodiment, the image forming apparatus includes an image forming device that forms an image, a counterpart including a sliding face, and the heater described above that heats the counterpart.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
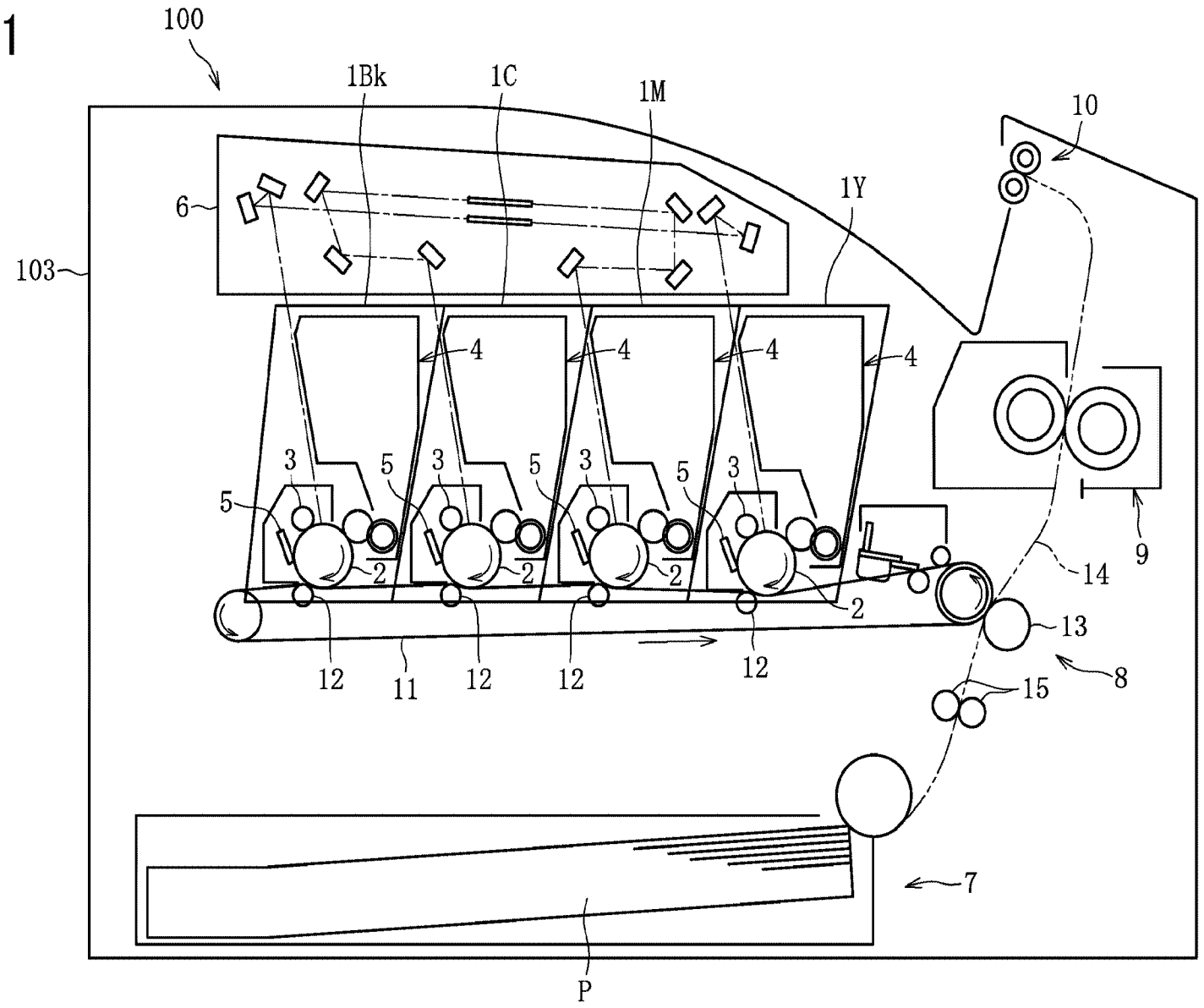
FIG. 1 is a schematic cross-sectional view of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to the attached drawings, the following describes a construction of an image forming apparatus 100 according to embodiments of the present disclosure.

In the drawings for explaining the embodiments of the present disclosure, identical reference numerals are assigned to elements such as members and parts that have an identical function or an identical shape as long as differentiation is possible and a description of those elements is omitted once the description is provided.

FIG. 1 is a schematic cross-sectional view of the image forming apparatus 100 according to an embodiment of the present disclosure. The image forming apparatus 100 is a printer. Alternatively, the image forming apparatus 100 may be a copier, a facsimile machine, a multifunction peripheral (MFP) having at least two of printing, copying, facsimile, scanning, and plotter functions, or the like.

As illustrated in FIG. 1, the image forming apparatus 100 includes four image forming units 1Y, 1M, 1C, and 1Bk serving as image forming devices, respectively. The image forming units 1Y, 1M, 1C, and 1Bk are removably installed in a body 103 of the image forming apparatus 100. The image forming units 1Y, 1M, 1C, and 1Bk have a similar construction except that the image forming units 1Y, 1M, 1C, and 1Bk contain developers in different colors, that is, yellow, magenta, cyan, and black, respectively, which correspond to color separation components for a color image. For example, each of the image forming units 1Y, 1M, 1C, and 1Bk includes a photoconductor 2, a charger 3, a developing device 4, and a cleaner 5. The photoconductor 2 is drum-shaped and serves as an image bearer. The charger 3 charges a surface of the photoconductor 2. The developing device 4 supplies toner as a developer to the surface of the photoconductor 2 to form a toner image. The cleaner 5 cleans the surface of the photoconductor 2.

The image forming apparatus 100 further includes an exposure device 6, a sheet feeding device 7, a transfer device 8, a fixing device 9, and a sheet ejection device 10. The exposure device 6 exposes the surface of each of the photoconductors 2 and forms an electrostatic latent image thereon. The sheet feeding device 7 supplies a sheet P serving as a recording medium to the transfer device 8. The transfer device 8 transfers the toner image formed on each of the photoconductors 2 onto the sheet P. The fixing device 9 fixes the toner image transferred onto the sheet P thereon. The sheet ejection device 10 ejects the sheet P onto an outside of the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor stretched taut across a plurality of rollers. The four primary transfer rollers 12 serve as primary transferors that transfer yellow, magenta, cyan, and black toner images formed on the photoconductors 2 onto the intermediate transfer belt 11, respectively, thus forming a full color toner image on the intermediate transfer belt 11. The secondary transfer roller 13 serves as a secondary transferor that transfers the full color toner image formed on the intermediate transfer belt 11 onto the sheet P. The plurality of primary transfer rollers 12 is pressed against the photoconductors 2, respectively, via the intermediate transfer belt 11. Thus, the intermediate transfer belt 11 contacts each of the photoconductors 2, forming a primary transfer nip therebetween. On the other hand, the secondary transfer roller 13 is pressed against one of the rollers across which the intermediate transfer belt 11 is stretched taut via the intermediate transfer belt 11. Thus, a secondary transfer nip is formed between the secondary transfer roller 13 and the intermediate transfer belt 11.

The image forming apparatus 100 accommodates a sheet conveyance path 14 through which the sheet P fed from the sheet feeding device 7 is conveyed. A timing roller pair 15 is disposed in the sheet conveyance path 14 at a position between the sheet feeding device 7 and the secondary transfer nip defined by the secondary transfer roller 13.

Referring to FIG. 1, a description is provided of printing processes performed by the image forming apparatus 100 having the construction described above.

When the image forming apparatus 100 receives an instruction to start printing, a driver drives and rotates the photoconductor 2 clockwise in FIG. 1 in each of the image forming units 1Y, 1M, 1C, and 1Bk. The charger 3 charges the surface of the photoconductor 2 uniformly at a high electric potential. Subsequently, the exposure device 6 exposes the surface of each of the photoconductors 2 based on image data created by an original scanner that reads an image on an original or print data instructed by a terminal, thus decreasing the electric potential of an exposed portion on the photoconductor 2 and forming an electrostatic latent image on the photoconductor 2. The developing device 4 supplies toner to the electrostatic latent image formed on the photoconductor 2, forming a toner image thereon.

When the toner images formed on the photoconductors 2 reach the primary transfer nips defined by the primary transfer rollers 12 in accordance with rotation of the photoconductors 2, respectively, the toner images formed on the photoconductors 2 are transferred onto the intermediate transfer belt 11 driven and rotated counterclockwise in FIG. 1 successively such that the toner images are superimposed on the intermediate transfer belt 11, forming a full color toner image thereon. Thereafter, the full color toner image formed on the intermediate transfer belt 11 is conveyed to the secondary transfer nip defined by the secondary transfer roller 13 in accordance with rotation of the intermediate transfer belt 11 and is transferred onto a sheet P conveyed to the secondary transfer nip. The sheet P is supplied from the sheet feeding device 7. The timing roller pair 15 temporarily halts the sheet P supplied from the sheet feeding device 7. Thereafter, the timing roller pair 15 conveys the sheet P to the secondary transfer nip at a time when the full color toner image formed on the intermediate transfer belt 11 reaches the secondary transfer nip. Accordingly, the full color toner image is transferred onto and borne on the sheet P. After the toner image is transferred onto the intermediate transfer belt 11, the cleaner 5 removes residual toner remained on the photoconductor 2 therefrom.

The sheet P transferred with the full color toner image is conveyed to the fixing device 9 that fixes the full color toner image on the sheet P. Thereafter, the sheet ejection device 10 ejects the sheet P onto the outside of the image forming apparatus 100, thus finishing a series of printing processes.

A description is provided of a construction of the fixing device 9.

Figure 2:
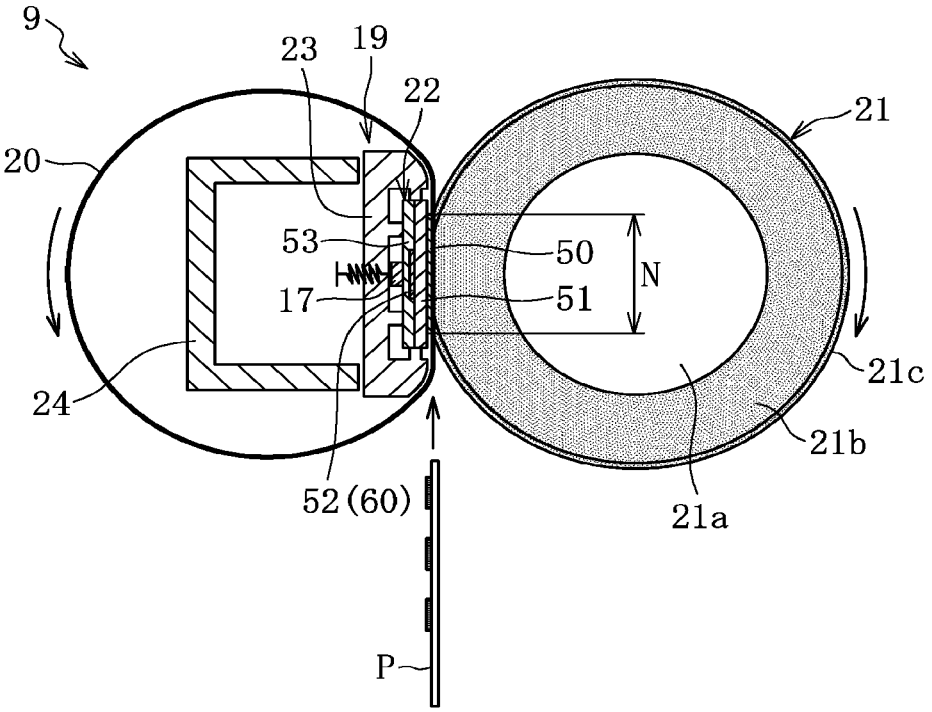
FIG. 2 is a schematic cross-sectional view of a fixing device incorporated in the image forming apparatus depicted in FIG. 1.

As illustrated in FIG. 2, the fixing device 9 according to the embodiments includes a fixing belt 20, a pressure roller 21, and a heating device 19 that includes the fixing belt 20. The fixing belt 20 is an endless belt serving as a fixing rotator or a fixing member. The pressure roller 21 serves as an opposed rotator or an opposed member that is disposed opposite an outer circumferential surface of the fixing belt 20. The heating device 19 further includes a heater 22, a heater holder 23, a stay 24, and a thermistor 17. The heater 22 is a laminated heater and serves as a heater or a heating member that heats the fixing belt 20. The heater holder 23 holds or supports the heater 22. The stay 24 serves as a reinforcement that contacts and reinforces the heater holder 23 throughout an entire length of the heater holder 23 in a longitudinal direction thereof. The thermistor 17 serves as a temperature detector.

A detailed description is now given of a construction of the fixing belt 20.

The fixing belt 20 includes a tubular base that is made of polyimide (PI) and has an outer diameter of 25 mm and a thickness in a range of from 40 μm to 120 μm, for example. The fixing belt 20 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 μm to 50 μm to enhance durability of the fixing belt 20 and facilitate separation of the sheet P and a foreign substance from the fixing belt 20. Optionally, an elastic layer that is made of rubber or the like and has a thickness in a range of from 50 μm to 500 μm may be interposed between the base and the release layer. The base of the fixing belt 20 may be made of heat resistant resin such as polyetheretherketone (PEEK) or metal such as nickel (Ni) and SUS stainless steel, instead of polyimide. An inner circumferential surface of the fixing belt 20 may be coated with polyimide, PTFE, or the like to produce a sliding layer.

A detailed description is now given of a construction of the pressure roller 21.

The pressure roller 21 has an outer diameter of 25 mm, for example. The pressure roller 21 includes a cored bar 21*a*, an elastic layer 21*b*, and a release layer 21*c*. The cored bar 21*a* is solid and made of metal such as iron. The elastic layer 21*b* is disposed on a surface of the cored bar 21*a*. The release layer 21*c* coats an outer surface of the elastic layer 21*b*. The elastic layer 21*b* is made of silicone rubber and has a thickness of 3.5 mm, for example. In order to facilitate separation of the sheet P and the foreign substance from the pressure roller 21, the release layer 21*c* that is made of fluororesin and has a thickness of about 40 μm, for example, is preferably disposed on the outer surface of the elastic layer 21*b*. Alternatively, instead of the pressure roller 21, an endless pressure belt or the like may be employed as an opposed rotator that is disposed opposite the outer circumferential surface of the fixing belt 20.

A detailed description is now given of a construction of the heater 22.

The heater 22 extends in a longitudinal direction thereof throughout an entire length of the fixing belt 20 in a longitudinal direction, that is, an axial direction, of the fixing belt 20. The heater 22 contacts the inner circumferential surface of the fixing belt 20 directly. Alternatively, the heater 22 may contact the outer circumferential surface of the fixing belt 20. However, if the outer circumferential surface of the fixing belt 20 is brought into contact with the heater 22 and damaged, the fixing belt 20 may degrade quality of fixing the toner image on the sheet P. Hence, the heater 22 contacts the inner circumferential surface of the fixing belt 20 advantageously. The heater 22 includes a slide layer 50, a base layer 51, a conductor layer 52 including a heat generator 60, and an insulating layer 53, which are layered in this order from the slide layer 50 to the insulating layer 53. The slide layer 50 defines a fixing belt side face of the heater 22, that contacts the fixing belt 20. The insulating layer 53 defines a heater holder side face of the heater 22, that contacts the heater holder 23 and is opposite the fixing belt side face.

A detailed description is now given of a construction of the heater holder 23 and the stay 24.

The heater holder 23 and the stay 24 are disposed inside a loop formed by the fixing belt 20. The stay 24 includes a channel made of metal. Both lateral ends of the stay 24 in a longitudinal direction thereof are supported by side walls (e.g., side plates) of the fixing device 9, respectively. The stay 24 supports a stay side face of the heater holder 23, that faces the stay 24 and is opposite a heater side face of the heater holder 23, that faces the heater 22. Accordingly, the stay 24 retains the heater 22 and the heater holder 23 to be immune from being bent substantially by pressure from the pressure roller 21, forming a fixing nip N between the fixing belt 20 and the pressure roller 21.

Since the heater holder 23 is subject to temperature increase by heat from the heater 22, the heater holder 23 is preferably made of a heat resistant material. For example, if the heater holder 23 is made of heat resistant resin having a decreased thermal conductivity, such as liquid crystal polymer (LCP) and PEEK, the heater holder 23 suppresses conduction of heat thereto from the heater 22, facilitating heating of the fixing belt 20.

A spring serving as a biasing member causes the fixing belt 20 and the pressure roller 21 to press against each other. Thus, the fixing nip N is formed between the fixing belt 20 and the pressure roller 21. As a driving force is transmitted to the pressure roller 21 from a driver disposed inside the body 103 of the image forming apparatus 100, the pressure roller 21 serves as a driving roller that drives and rotates the fixing belt 20. The fixing belt 20 is driven and rotated by the pressure roller 21 as the pressure roller 21 rotates. While the fixing belt 20 rotates, the fixing belt 20 slides over the heater 22. In order to facilitate sliding of the fixing belt 20, a lubricant such as oil and grease may be interposed between the heater 22 and the fixing belt 20.

When printing starts, the driver drives and rotates the pressure roller 21 and the fixing belt 20 starts rotation in accordance with rotation of the pressure roller 21. Additionally, as power is supplied to the heater 22, the heater 22 heats the fixing belt 20. In a state in which the temperature of the fixing belt 20 reaches a predetermined target temperature (e.g., a fixing temperature), as a sheet P bearing an unfixed toner image is conveyed through the fixing nip N formed between the fixing belt 20 and the pressure roller 21 as illustrated in FIG. 2, the fixing belt 20 and the pressure roller 21 fix the unfixed toner image on the sheet P under heat and pressure.

Figure 3:
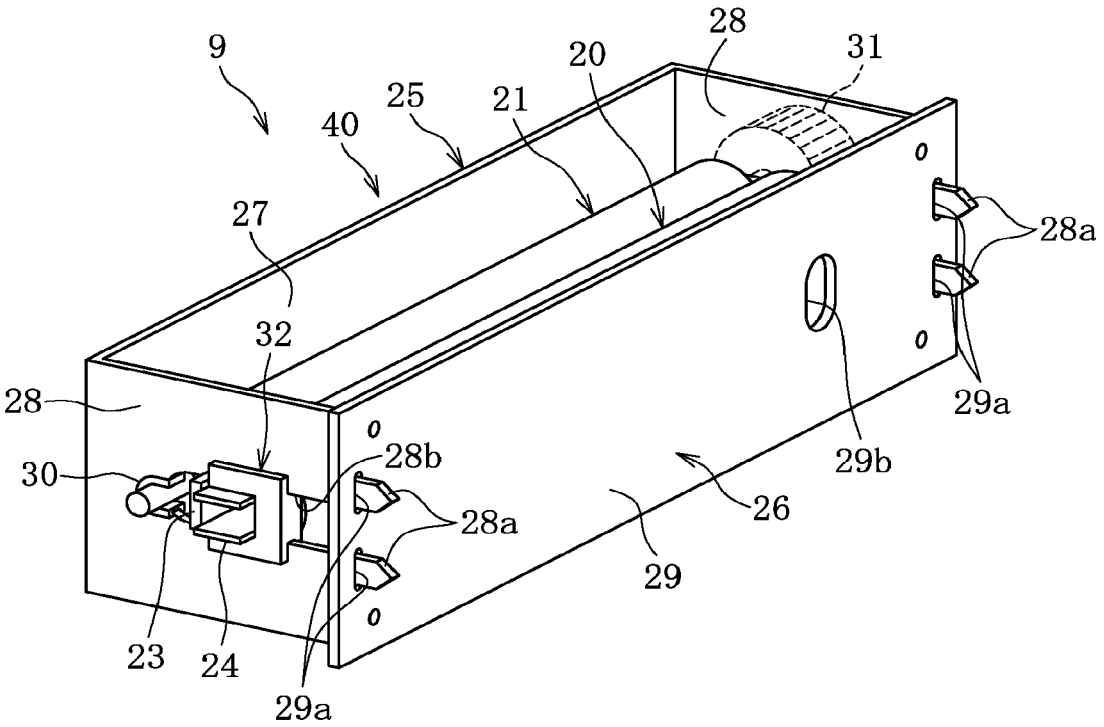
FIG. 3 is a perspective view of the fixing device depicted in FIG. 2.
Figure 4:
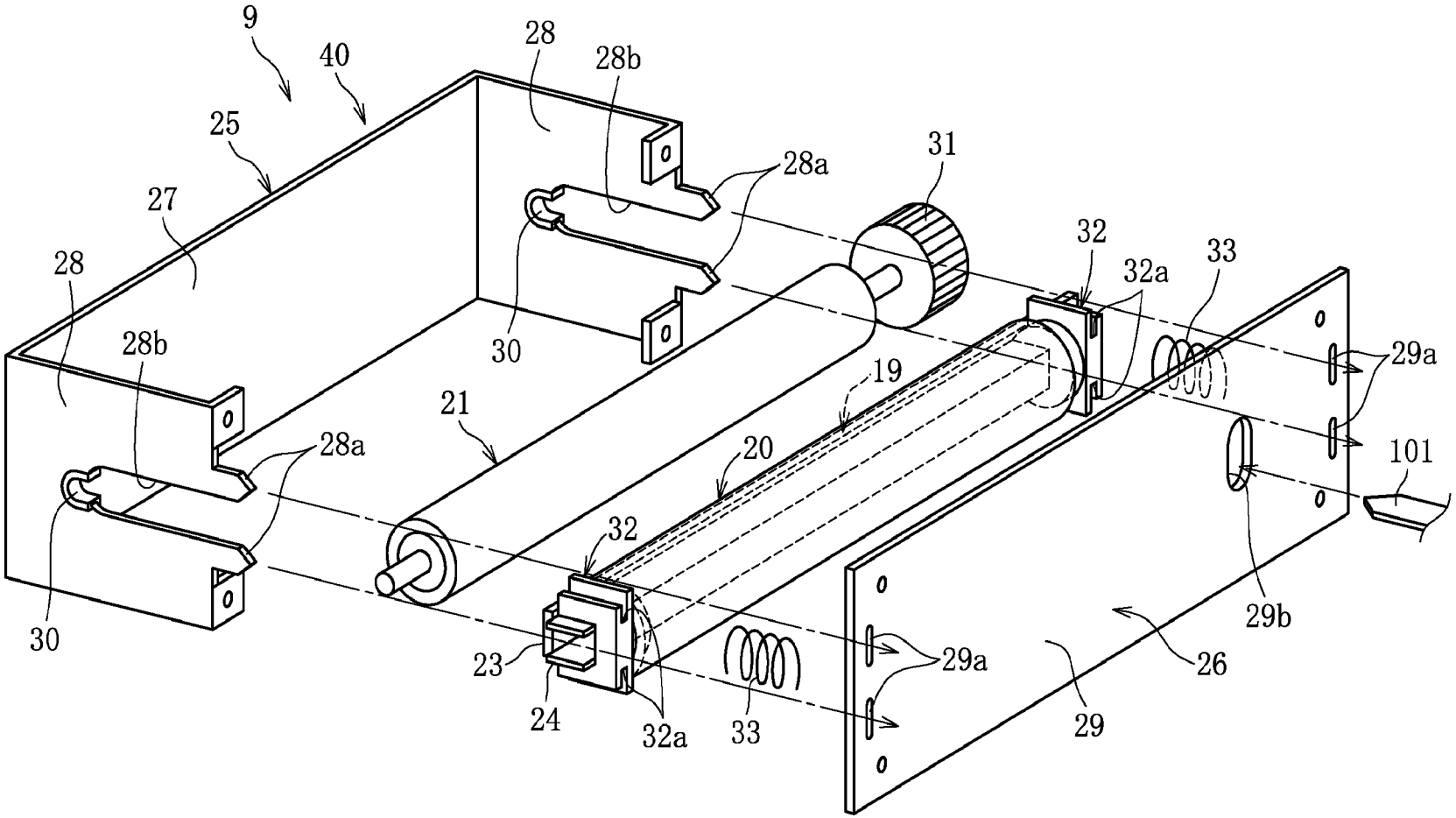
FIG. 4 is an exploded perspective view of the fixing device depicted in FIG. 3.

FIG. 3 is a perspective view of the fixing device 9. FIG. 4 is an exploded perspective view of the fixing device 9.

As illustrated in FIGS. 3 and 4, the fixing device 9 includes a device frame 40 that includes a first device frame 25 and a second device frame 26. The first device frame 25 includes a pair of side walls 28 and a front wall 27. The second device frame 26 includes a rear wall 29. The side walls 28 are disposed at one lateral end and another lateral end of the fixing belt 20, respectively, in the longitudinal direction thereof. The side walls 28 support both lateral ends of each of the pressure roller 21 and the heating device 19, respectively. Each of the side walls 28 includes a plurality of engaging projections 28*a*. As the engaging projections 28*a* engage engaging holes 29*a* penetrating through the rear wall 29, respectively, the first device frame 25 is coupled to the second device frame 26.

Each of the side walls 28 includes an insertion recess 28*b* through which a rotation shaft and the like of the pressure roller 21 are inserted. The insertion recess 28*b* is open at an opening that faces the rear wall 29 and closed at a bottom that is opposite the opening and serves as a contact portion. A bearing 30 that supports the rotation shaft of the pressure roller 21 is disposed at an end of the insertion recess 28*b*, that serves as the contact portion. As both lateral ends of the rotation shaft of the pressure roller 21 in an axial direction thereof are attached to the bearings 30, respectively, the side walls 28 rotatably support the pressure roller 21.

A driving force transmission gear 31 serving as a driving force transmitter is disposed at one lateral end of the rotation shaft of the pressure roller 21 in the axial direction thereof. In a state in which the side walls 28 support the pressure roller 21, the driving force transmission gear 31 is exposed outside the side wall 28. Accordingly, when the fixing device 9 is installed in the body 103 of the image forming apparatus 100, the driving force transmission gear 31 is coupled to a gear disposed inside the body 103 of the image forming apparatus 100 so that the driving force transmission gear 31 transmits the driving force from the driver. Alternatively, a driving force transmitter that transmits the driving force to the pressure roller 21 may be pulleys over which a driving force transmission belt is stretched taut, a coupler, and the like instead of the driving force transmission gear 31.

A pair of supports 32 that supports the fixing belt 20, the heater holder 23, the stay 24, and the like is disposed at both lateral ends of the heating device 19 in a longitudinal direction thereof, respectively. Each of the supports 32 includes guide grooves 32*a*. As the guide grooves 32*a* move along edges of the insertion recess 28*b* of the side wall 28, respectively, the support 32 is attached to the side wall 28.

Each of a pair of springs 33 serving as a pair of biasing members is interposed between each of the supports 32 and the rear wall 29. As the springs 33 bias the stay 24 and the supports 32 toward the pressure roller 21, respectively, the fixing belt 20 is pressed against the pressure roller 21 to form the fixing nip N between the fixing belt 20 and the pressure roller 21.

As illustrated in FIG. 4, a hole 29*b* is disposed at one lateral end of the rear wall 29 of the second device frame 26 in a longitudinal direction thereof. The hole 29*b* serves as a positioner that positions a body of the fixing device 9 with respect to the body 103 of the image forming apparatus 100. On the other hand, a projection 101 serving as a positioner is mounted on the body 103 of the image forming apparatus 100. As the projection 101 is inserted into the hole 29*b* of the fixing device 9, the projection 101 engages the hole 29*b*, positioning the body of the fixing device 9 with respect to the body 103 of the image forming apparatus 100 in the longitudinal direction of the fixing belt 20. Although the hole 29*b* serving as a positioner is disposed at one lateral end of the rear wall 29 in the longitudinal direction of the second device frame 26, another positioner is not disposed at another lateral end of the rear wall 29. Thus, the second device frame 26 does not restrict thermal expansion and shrinkage of the body of the fixing device 9 in the longitudinal direction of the fixing belt 20 due to temperature change.

Figure 5:
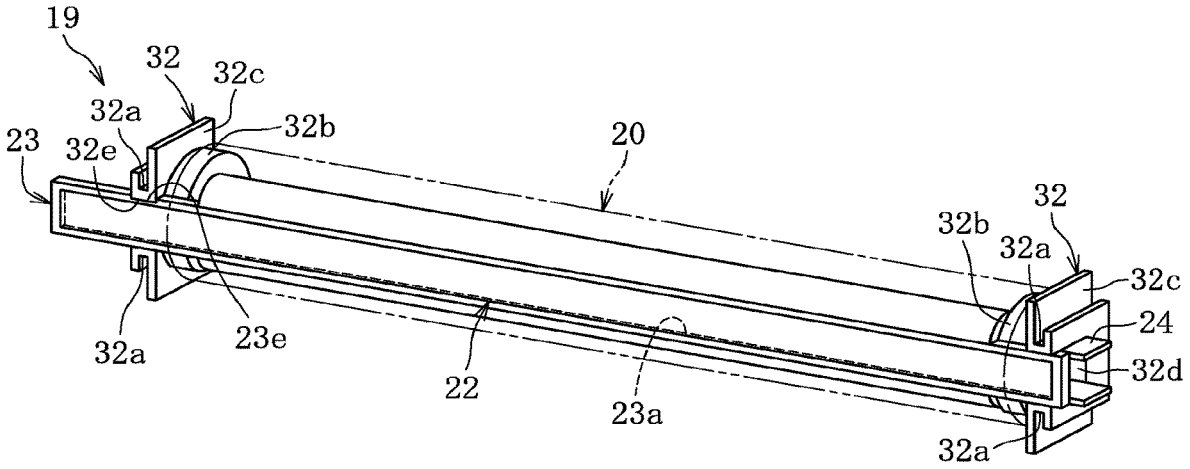
FIG. 5 is a perspective view of a heating device incorporated in the fixing device depicted in FIG. 2.
Figure 6:
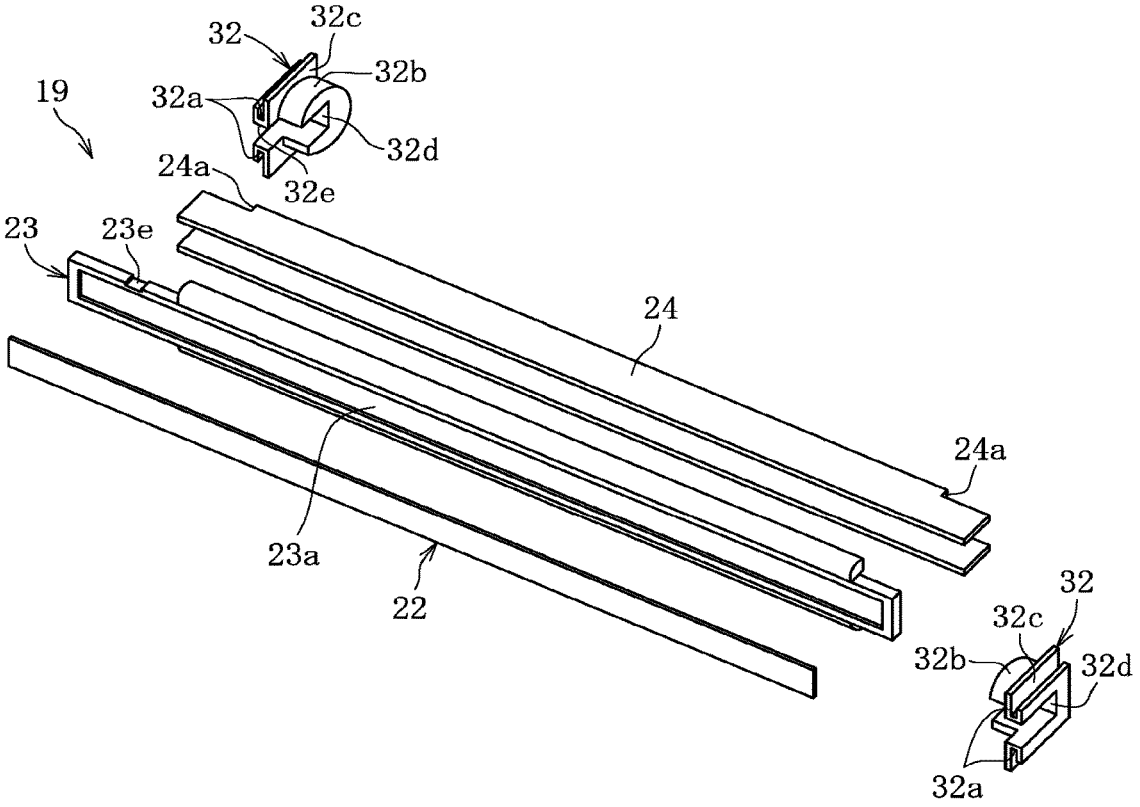
FIG. 6 is an exploded perspective view of the heating device depicted in FIG. 5.

FIG. 5 is a perspective view of the heating device 19. FIG. 6 is an exploded perspective view of the heating device 19.

As illustrated in FIGS. 5 and 6, the heater holder 23 includes an accommodating recess 23*a* disposed on a fixing belt side face (e.g., a front face in FIGS. 5 and 6) of the heater holder 23, that faces the fixing belt 20. The accommodating recess 23*a* is rectangular and accommodates the heater 22. A connector serving as a feeding member described below sandwiches the heater 22 and the heater holder 23 in a state in which the accommodating recess 23*a* accommodates the heater 22, thus holding the heater 22.

Each of the pair of supports 32 includes a belt support 32*b*, a belt restrictor 32*c*, and a supporting recess 32*d*. The belt support 32*b* is C-shaped and inserted into the loop formed by the fixing belt 20, thus contacting the inner circumferential surface of the fixing belt 20 to support the fixing belt 20. The belt restrictor 32*c* is a flange that contacts an edge face of the fixing belt 20 to restrict motion (e.g., skew) of the fixing belt 20 in the longitudinal direction thereof. The supporting recess 32*d* is inserted with a lateral end of each of the heater holder 23 and the stay 24 in the longitudinal direction thereof, thus supporting the heater holder 23 and the stay 24. The belt supports 32*b* are inserted into the loop formed by the fixing belt 20 at both lateral ends of the fixing belt 20 in the axial direction thereof, respectively. Hence, the belt supports 32*b* support the fixing belt 20 in a state in which the fixing belt 20 is not basically applied with tension in a circumferential direction (e.g., a rotation direction) thereof while the fixing belt 20 does not rotate, that is, by a free belt system.

As illustrated in FIGS. 5 and 6, the heater holder 23 includes a positioning recess 23*e*, serving as a positioner, disposed at one lateral end of the heater holder 23 in the longitudinal direction thereof. The support 32 includes an engagement 32*e* illustrated in a left part in FIGS. 5 and 6. The engagement 32*e* engages the positioning recess 23*e*, positioning the heater holder 23 with respect to the support 32 in the longitudinal direction of the fixing belt 20. The support 32 illustrated in a right part in FIGS. 5 and 6 does not include the engagement 32*e* and therefore the heater holder 23 is not positioned with respect to the support 32 in the longitudinal direction of the fixing belt 20. As described above, the heater holder 23 is positioned with respect to the support 32 at one lateral end of the heater holder 23 in the longitudinal direction of the fixing belt 20. Thus, the support 32 does not restrict thermal expansion and shrinkage of the heater holder 23 in the longitudinal direction of the fixing belt 20 due to temperature change.

As illustrated in FIG. 6, the stay 24 includes steps 24*a* disposed at both lateral ends of the stay 24 in the longitudinal direction thereof, respectively. The steps 24*a* restrict motion of the stay 24 with respect to the supports 32, respectively, in the longitudinal direction of the stay 24. As the step 24*a* comes into contact with the support 32, the step 24*a* restricts motion of the stay 24 with respect to the support 32 in the longitudinal direction thereof. A gap (e.g., backlash) is provided between at least one of the steps 24*a* and the support 32. Thus, the gap is provided between at least one of the steps 24*a* and the support 32 so that the support 32 does not restrict thermal expansion and shrinkage of the stay 24 in the longitudinal direction of the fixing belt 20 due to temperature change.

Figure 7:
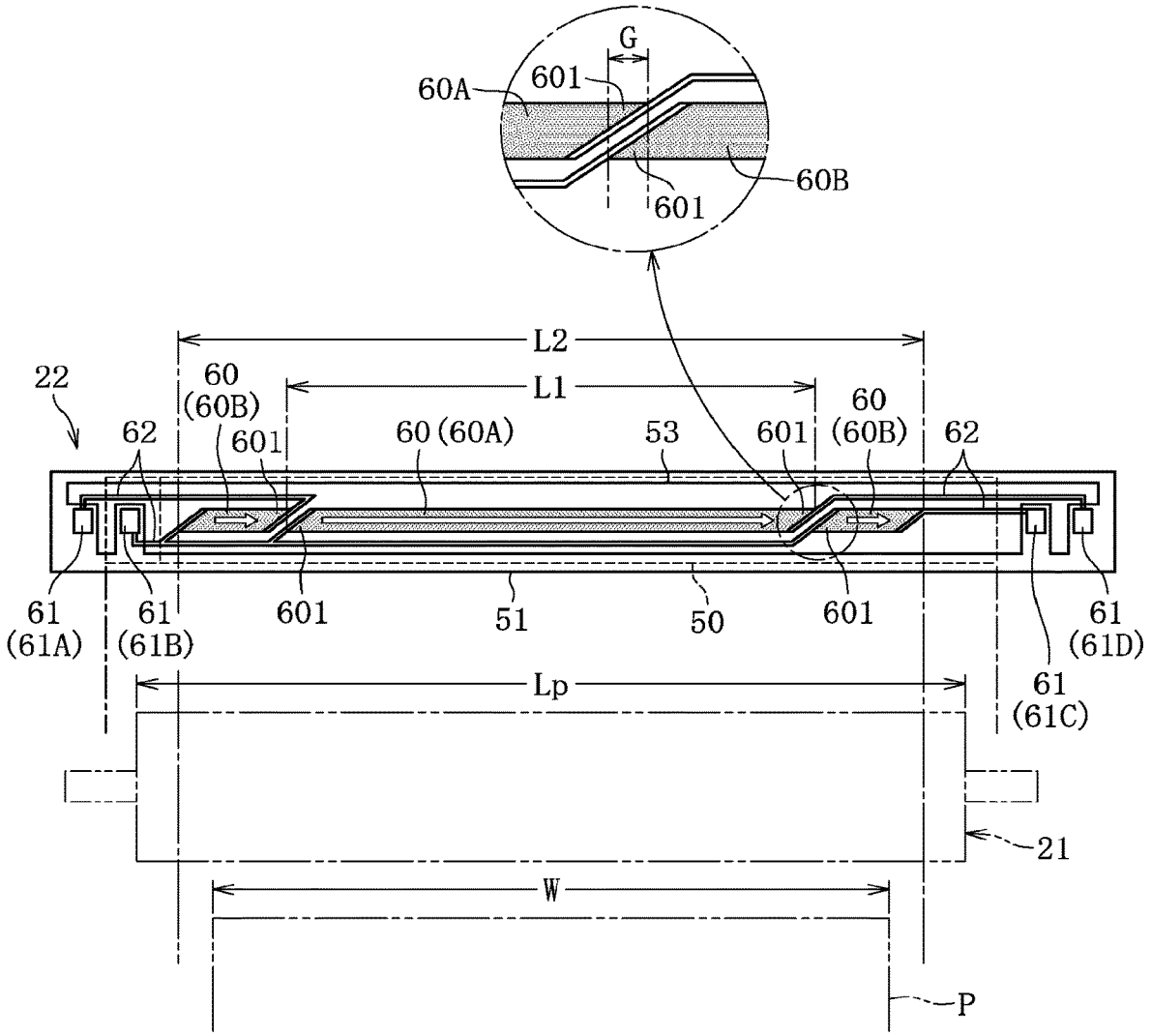
FIG. 7 is a plan view of a heater incorporated in the heating device depicted in FIG. 6.
Figure 8:
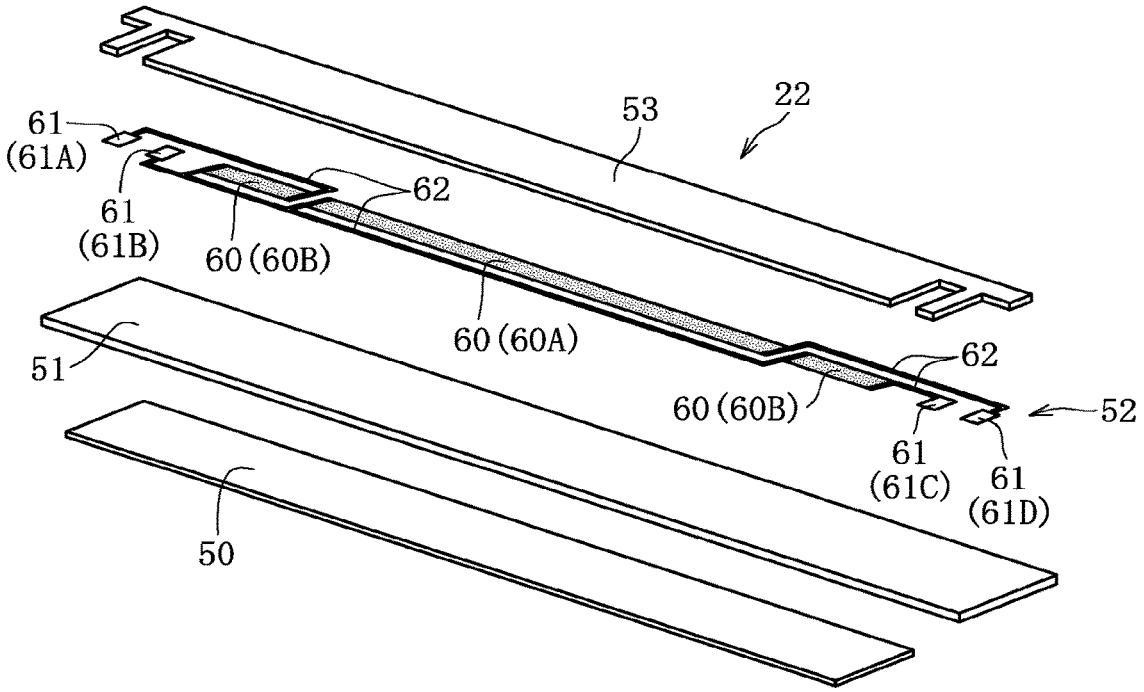
FIG. 8 is an exploded perspective view of the heater depicted in FIG. 7.

FIG. 7 is a plan view of the heater 22. FIG. 8 is an exploded perspective view of the heater 22.

As illustrated in FIG. 8, the heater 22 has a multilayer structure in which a plurality of layers, that is, the slide layer 50, the base layer 51, the conductor layer 52, and the insulating layer 53, is layered. The base layer 51 is platy. The slide layer 50 is mounted on a fixing belt side face (e.g., a lower face in FIG. 8) of the base layer 51, that is disposed opposite the fixing belt 20. The conductor layer 52 is mounted on a heater holder side face of the base layer 51, that is disposed opposite the heater holder 23 and is opposite the fixing belt side face of the base layer 51, that mounts the slide layer 50. The insulating layer 53 coats the conductor layer 52. The conductor layer 52 includes a plurality of heat generators 60, a plurality of electrodes 61, and a plurality of feeders 62. Each of the heat generators 60 is a laminated, resistive heat generator. The electrodes 61 are mounted on both lateral ends of the base layer 51, respectively, in a longitudinal direction thereof. Each of the feeders 62 connects the electrode 61 to the heat generator 60. As illustrated in FIG. 7, at least a part of each of the electrodes 61 is not coated with the insulating layer 53 and is exposed so that the electrodes 61 are connected to the connector described below.

The base layer 51 is made of an insulating material, for example, ceramic such as alumina and aluminum nitride, glass, or the like. Alternatively, the base layer 51 may be made of metal such as stainless steel (e.g., SUS stainless steel), iron, copper, and aluminum. A separate insulating layer may be interposed between the base layer 51 and the conductor layer 52 to ensure insulation. Since metal has an enhanced durability against rapid heating and is processed readily, metal is preferably used to reduce manufacturing costs. Among metals, aluminum and copper are preferable because aluminum and copper attain an increased thermal conductivity and barely suffer from uneven temperature. Stainless steel is advantageous because stainless steel is manufactured at reduced costs compared to aluminum and copper. As illustrated in FIG. 2, according to the embodiments, heat generated by the heat generators 60 is conducted to the fixing belt 20 through the base layer 51. Hence, the base layer 51 is preferably made of a material having an increased thermal conductivity, such as aluminum nitride. The base layer 51 made of the material having the increased thermal conductivity heats the fixing belt 20 sufficiently, even if the heat generators 60 are disposed on the heater holder side face of the base layer 51, that is opposite the fixing belt side face of the base layer 51.

The slide layer 50 is mounted on the fixing belt side face of the base layer 51, that is disposed opposite the fixing belt 20. The slide layer 50 contacts the inner circumferential surface of the fixing belt 20. The slide layer 50 is made of a material containing fluorine such as PTFE so that the fixing belt 20 slides over the slide layer 50 smoothly. The slide layer 50 that is made of PTFE or the like and has a cross-linked structure improves abrasion resistance.

The insulating layer 53 is made of heat resistant glass. Alternatively, the insulating layer 53 may be made of ceramic, PI, or the like.

For example, each of the heat generators 60 is produced as below. Silver-palladium (AgPd), glass powder, and the like are mixed into paste. The paste coats the base layer 51 by screen printing or the like. Thereafter, the base layer 51 is subject to firing. Alternatively, the heat generators 60 may be made of a resistive material such as a silver alloy (AgPt) and ruthenium oxide ($RuO_2$).

The feeders 62 are made of a conductor having a resistance value smaller than a resistance value of the heat generators 60. The feeders 62 and the electrodes 61 are made of a material prepared with silver (Ag), silver-palladium (AgPd), or the like. The feeders 62 and the electrodes 61 are produced by screen printing or the like with the material described above.

According to the embodiments, the heat generators 60, the electrodes 61, and the feeders 62 are made of an alloy of silver, palladium, or the like to attain the heat generators 60 having a positive temperature coefficient (PTC) property, that is, a positive temperature coefficient of resistance. The PTC property defines a property in which the resistance value increases as the temperature increases, for example, a heater output decreases under a given voltage. The heat generators 60 having the PTC property start quickly with an increased output at low temperatures and suppress overheating with a decreased output at high temperatures. For example, if a temperature coefficient of resistance (TCR) of the PTC property is in a range of from about 200 ppm/° C. to about 4,000 ppm/° C., preferably in a range of from 400 ppm/° C. to 2,000 ppm/° C., the heater 22 achieves an extended life and a simple temperature control while retaining a resistance value needed for the heater 22.

The TCR is calculated with a formula (1) below. In the formula (1), T0 represents a reference temperature. T1 represents an arbitrary temperature. R0 represents a resistance value at the reference temperature T0. R1 represents a resistance value at the arbitrary temperature T1. For example, according to the embodiments, if the resistance value between a first electrode 61A, a second electrode 61B, and a third electrode 61C or the resistance value between the second electrode 61B, the third electrode 61C, and a fourth electrode 61D depicted in FIG. 7 is 10Ω, as the resistance value R0, at 25 degrees Celsius, as the reference temperature T0, and 12Ω, as the resistance value R1, at 125 degrees Celsius, as the arbitrary temperature T1, the TCR is 2,000 ppm/° C. according to the formula (1).

Formula (1)

$$TCR=(R1-R0)/R0/(T1-T0)\times 10^6 \quad (1)$$

According to the embodiments, the three heat generators 60 are arranged in the longitudinal direction of the base layer 51. One of the three heat generators 60 is a center heat generator 60A serving as a primary heat generator disposed on a center of the base layer 51 in the longitudinal direction thereof. Remaining two of the three heat generators 60 are lateral end heat generators 60B serving as secondary heat generators that sandwich the center heat generator 60A in the longitudinal direction of the base layer 51. A controller controls the center heat generator 60A and the lateral end heat generators 60B to generate heat separately from each other.

As illustrated in FIG. 7, the plurality of electrodes 61 includes the first electrode 61A, the second electrode 61B, the third electrode 61C, and the fourth electrode 61D, which are arranged in this order from left to right in FIG. 7. When the second electrode 61B and the fourth electrode 61D are applied with a voltage, the center heat generator 60A generates heat. When the first electrode 61A and the second electrode 61B are applied with a voltage, the left, lateral end heat generator 60B in FIG. 7 generates heat. When the second electrode 61B and the third electrode 61C are applied with a voltage, the right, lateral end heat generator 60B in FIG. 7 generates heat. If the first electrode 61A and the third electrode 61C are connected in parallel in an outside of the heater 22 and configured to be applied with a voltage simultaneously, when the first electrode 61A, the third electrode 61C, and the second electrode 61B are applied with a voltage, the controller controls both the lateral end heat generators 60B to generate heat simultaneously. Arrows in FIG. 7 indicate directions in which an electric current flows in longitudinal directions of the center heat generator 60A and the lateral end heat generators 60B, respectively.

If a width of a sheet P conveyed through the fixing device 9 is not greater than a length L1 of the center heat generator 60A in the longitudinal direction of the heater 22, the center heat generator 60A generates heat. If a width of a sheet P conveyed through the fixing device 9 is greater than the length L1 of the center heat generator 60A in the longitudinal direction of the heater 22, the center heat generator 60A and the lateral end heat generators 60B generate heat. Thus, the heater 22 changes a heat generating span in the longitudinal direction thereof according to a conveyance span where the sheet P is conveyed, that is, the width of the sheet P. The length L1 of the center heat generator 60A is equivalent to a width of a small sheet P, for example, a width of 215 mm of an A4 size sheet in portrait orientation. A length L2 of a heat generating span defines a combined length of a length of one lateral end heat generator 60B, a length of the center heat generator 60A, and a length of another lateral end heat generator 60B in the longitudinal direction of the heater 22. The length L2 is equivalent to a width of a large sheet P, for example, a width of 301 mm of an A3 size sheet in portrait orientation. Accordingly, when the small sheet P and the large sheet P are conveyed, the heater 22 barely suffers from overheating in a non-conveyance span where the small sheet P and the large sheet P are not conveyed. That is, the non-conveyance span is barely produced on the center heat generator 60A and the lateral end heat generators 60B. Consequently, the heater 22 improves productivity in printing.

The length L2 of the heat generating span defines the combined length of the length of one lateral end heat generator 60B, the length of the center heat generator 60A, and the length of another lateral end heat generator 60B in the longitudinal direction of the heater 22. The length L2 is preferably greater than a maximum conveyance span W where a maximum sheet P is conveyed. Accordingly, the heater 22 effectively increases the temperature of both lateral ends of the fixing belt 20 in the longitudinal direction thereof, although the temperature of both lateral ends of the fixing belt 20 increases slowly, thus shortening a warm-up time taken to heat the fixing belt 20 to the fixing temperature at which the toner image is fixed on the sheet P. Additionally, the heater 22 also suppresses uneven temperature within the maximum conveyance span W.

As illustrated in FIG. 7, the pressure roller 21 includes a roller portion that has a length Lp in the axial direction of the pressure roller 21. The length Lp is preferably greater than the length L2 of the heat generating span that defines the combined length of the length of one lateral end heat generator 60B, the length of the center heat generator 60A, and the length of another lateral end heat generator 60B in the longitudinal direction of the heater 22. Conversely, if the length L2 of the heat generating span is greater than the length Lp of the roller portion of the pressure roller 21 in the axial direction thereof, the heater 22 may suffer from overheating in each outboard span disposed outboard from the roller portion in the axial direction of the pressure roller 21. To address this circumstance, the length Lp of the roller portion of the pressure roller 21 in the axial direction thereof is greater than the length L2 of the heat generating span that defines the combined length of the length of one lateral end heat generator 60B, the length of the center heat generator 60A, and the length of another lateral end heat generator 60B in the longitudinal direction of the heater 22, thus suppressing overheating of the heater 22.

As illustrated in FIG. 7, according to the embodiments, each of the center heat generator 60A and the lateral end heat generators 60B includes slopes 601 disposed at both lateral ends of each of the center heat generator 60A and the lateral end heat generators 60B, respectively, in the longitudinal direction of the heater 22. The slopes 601 are inclined relative to a sheet conveyance direction, that is, a vertical direction in FIG. 7, in which the sheet P is conveyed. At least a part of one of the slopes 601 overlaps at least a part of an adjacent one of the slopes 601 in a predetermined region G in the longitudinal direction of the heater 22, as illustrated in an enlarged view in FIG. 7. Accordingly, the slopes 601 that overlap each other suppress temperature decrease in a gap between the center heat generator 60A and each of the lateral end heat generators 60B and thereby decrease variation in fixing the toner image on the sheet P in a width direction thereof.

Figure 9:
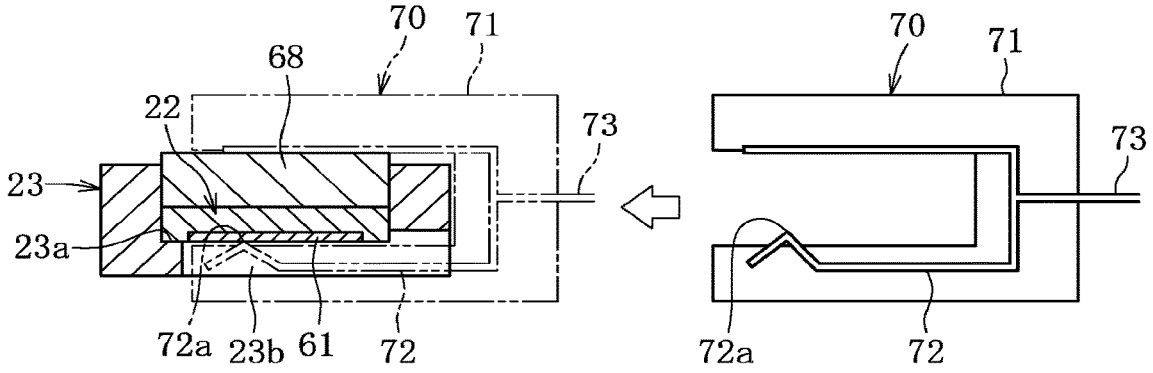
FIG. 9 is a cross-sectional view of the heater depicted in FIG. 8, illustrating a connector coupled to the heater.

FIG. 9 illustrates a construction of a connector 70 coupled to the heater 22.

As illustrated in FIG. 9, the connector 70 includes a housing 71 made of resin, a contact terminal 72 anchored to the housing 71, and a harness 73 (e.g., lead wire) coupled to the contact terminal 72. The contact terminal 72 is a flat spring. The harness 73 supplies power. The contact terminal 72 (e.g., the flat spring) includes contacts 72*a* that contact the electrodes 61 of the heater 22, respectively.

As illustrated in FIG. 9 with an alternate long and two short dashes line, the connector 70 is attached to the heater 22 and the heater holder 23 such that the connector 70 sandwiches the heater 22 and the heater holder 23 together vertically in FIG. 9. According to the embodiments, an upper portion of the connector 70 in FIG. 9 is disposed opposite a face of the heater 22, that is opposite an electrode side face of the heater 22, that is provided with the electrodes 61, via a spacer 68. Alternatively, the connector 70 may contact the heater 22 directly without the spacer 68 interposed between the connector 70 and the heater 22. A hole 23*b* is disposed in a bottom face of the accommodating recess 23*a* of the heater holder 23. The contact 72*a* of the contact terminal 72 contacts and presses against the electrode 61 resiliently through the hole 23*b*. Accordingly, the electrodes 61 are electrically connected to a power supply disposed in the image forming apparatus 100 through the connector 70, allowing the power supply to supply power to the heat generators 60.

A description is provided of a construction of a comparative fixing device.

The comparative fixing device includes a ceramic heater disposed inside a loop formed by a tubular fixing film. The ceramic heater and a pressure roller sandwich the fixing film to form a nip between the fixing film and the pressure roller. As the pressure roller is driven and rotated, the pressure roller drives and rotates the fixing film. While the pressure roller and the fixing film convey a recording medium through the nip, the ceramic heater heats the recording medium through the fixing film. Thus, the fixing film and the pressure roller fix an unfixed toner image on the recording medium under heat and pressure.

A surface of the ceramic heater, that contacts the fixing film, is made of fluororesin, decreasing the resistance between the ceramic heater and the fixing film that slides over the ceramic heater.

A slide portion between components that slide over relatively, for example, a slide portion between the ceramic heater and the fixing film that slides over the ceramic heater, may generate noise due to stick-slip.

According to the embodiments, the fixing belt 20 slides over the heater 22. As the fixing belt 20 slides over the heater 22 with a decreased friction, the resistance between the heater 22 and the fixing belt 20 that slides over the heater 22 decreases preferably. However, if the inner circumferential surface of the fixing belt 20 and the fixing belt side face of the heater 22, that faces the fixing belt 20, are treated with mirror finish to decrease the resistance between the heater 22 and the fixing belt 20 that slides over the heater 22 frictionally, the fixing belt 20 contacts the heater 22 with an increased adhesion, generating noise (e.g., chattering noise) due to stick-slip easily.

To address this circumstance, the fixing device 9 according to the embodiments has a construction described below to suppress noise caused by stick-slip between the fixing belt 20 and the heater 22.

Figure 10:
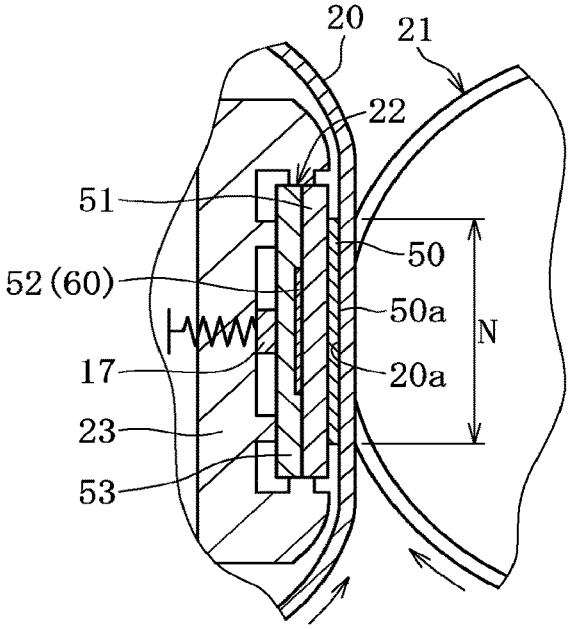
FIG. 10 is an enlarged view of the heater and a fixing belt incorporated in the fixing device depicted in FIG. 2, illustrating the fixing belt sliding over the heater.

In order to suppress noise caused by stick-slip, the fixing device 9 according to the embodiments has surface roughness below. For example, as illustrated in FIG. 10, the slide layer 50 of the heater 22 includes a fixing belt side face 50*a*, serving as a slide face, that faces the fixing belt 20. The fixing belt 20 includes a heater side face 20*a*, serving as a sliding face, that faces the heater 22. A surface roughness of the fixing belt side face 50*a* of the slide layer 50 is greater than a surface roughness of the heater side face 20*a* of the fixing belt 20. The surface roughness of each of the slide layer 50 and the fixing belt 20 is specified by a ten-point average roughness (Rz) defined by JIS B0601-1994 of the Japanese Industrial Standards, for example. The ten-point average roughness (Rz) is measured by a method conforming to JIS B0601-2001 of the Japanese Industrial Standards under an evaluation length (Ln) of 1.5 mm, a reference length (L) of 0.25 mm, and a cutoff value of 0.8 mm with a surface roughness meter, SURFCOM 1400A available from TOKYO SEIMITSU CO., LTD.

As described above, the surface roughness of the fixing belt side face 50*a* of the slide layer 50 is greater than the surface roughness of the heater side face 20*a* of the fixing belt 20, moderating adhesion between the slide layer 50 and the fixing belt 20 and suppressing noise caused by stick-slip between the slide layer 50 and the fixing belt 20. For example, noise caused by stick-slip tends to generate frequently if the surface roughness of each of the inner circumferential surface of the fixing belt 20 and the fixing belt side face 50*a* of the heater 22, that is disposed opposite the inner circumferential surface of the fixing belt 20, decreases and the inner circumferential surface of the fixing belt 20 and the fixing belt side face 50*a* of the heater 22 are treated with mirror finish. If the inner circumferential surface (e.g., the heater side face 20*a*) of the fixing belt 20 has a decreased surface roughness, the fixing device 9 according to the embodiments achieves substantial advantages. If the surface roughness of the inner circumferential surface of the fixing belt 20 increases, the fixing belt 20 contacts the heater 22 with a decreased contact area, degrading conduction of heat from the heater 22 to the fixing belt 20.

To address this circumstance, the surface roughness of the inner circumferential surface of the fixing belt 20 is preferably a ten-point average roughness (Rz) of 5.5 μm or smaller and more preferably 2.5 μm or smaller. Noise caused by stick-slip generates between the fixing belt side face 50*a* of the slide layer 50 of the heater 22 and the heater side face 20*a* of the fixing belt 20, that contacts and slides over the fixing belt side face 50*a* of the slide layer 50. Hence, a relation described above between the surface roughness of the slide layer 50 of the heater 22 and the surface roughness of the fixing belt 20 is established at least between the fixing belt side face 50*a* of the slide layer 50 and the heater side face 20*a* of the fixing belt 20, that contacts and slides over the fixing belt side face 50*a* of the slide layer 50. For example, at least the surface roughness of the fixing belt side face 50*a* of the slide layer 50 of the heater 22, that contacts the fixing belt 20, is greater than the surface roughness of the heater side face 20*a* of the fixing belt 20, that contacts and slides over the fixing belt side face 50*a* of the slide layer 50.

As illustrated in FIG. 7 with a dotted line, the slide layer 50 of the heater 22 is preferably longer than the length Lp of the roller portion of the pressure roller 21 in the axial direction thereof, that is, the longitudinal direction of the fixing belt 20. The fixing belt 20 slides over the heater 22 in a slide span that is equivalent to a contact span where the pressure roller 21 contacts the fixing belt 20, that is, the length Lp of the roller portion of the pressure roller 21 in the axial direction thereof. Accordingly, the slide layer 50 of the heater 22 is longer than the roller portion of the pressure roller 21 in the axial direction thereof, facilitating sliding of the fixing belt 20 over the heater 22 throughout the entire slide span.

A description is provided of a test to confirm advantages of the embodiments of the present disclosure.

The test was performed with a fixing belt including a tubular base made of nickel electroforming. An outer circumferential surface of the base was coated with a silicone rubber layer having a thickness of 300 μm. As an outermost layer, a tube that was made of PFA and had a thickness of 30 μm coated the silicone rubber layer. A polyimide (PI) film having a thickness of 20 μm was used as an inner circumferential surface of the base. The polyimide film as an inner circumferential surface of the fixing belt had a ten-point average roughness (Rz) of 1.5 μm.

The test used samples according to Comparative Example 1 and Embodiments 1, 2, 3, and 4 described in Table 1 below, respectively, as heaters. Each of the heaters as the samples described in Table 1 had a construction equivalent to the construction of the heater 22 depicted in FIGS. 7 and 8. For example, a slide layer containing fluorine was mounted on a fixing belt side face of a base layer of the heater, that was disposed opposite the fixing belt. As illustrated in Table 1, the heaters as the samples had different ten-point average roughnesses (Rz), respectively, for a fixing belt side face of the slide layer, that faced the fixing belt.

The heaters as the samples used in the test were different from each other in a skewness (Rsk) of a roughness curve in a slide direction in which the fixing belt slid over the heater and a kurtosis (Rku) of the roughness curve in the slide direction, in addition to the ten-point average roughness (Rz) of the slide layer. In the present specification, the slide direction denotes the slide direction (e.g., the rotation direction of the fixing belt 20) in which the fixing belt 20 slides over the heater 22.

The skewness (Rsk) of the roughness curve is one index for the surface roughness defined by JIS B0601-2013, 4.2.3 of the Japanese Industrial Standards. The skewness (Rsk) indicates a degree of symmetry between a crest and a trough via an average line. The skewness (Rsk) of the roughness curve is calculated with cube mean of z(x) in a non-dimensional reference length obtained by cubing a root-mean-square roughness (Rq) of a cross-sectional curve according to a formula (2) below.

Formula (2)

$$Rsk = \frac{1}{Rq^3}\left[\frac{1}{\ell}\int_0^{\ell} z^3(x)dx\right] \quad (2)$$

Figure 11:
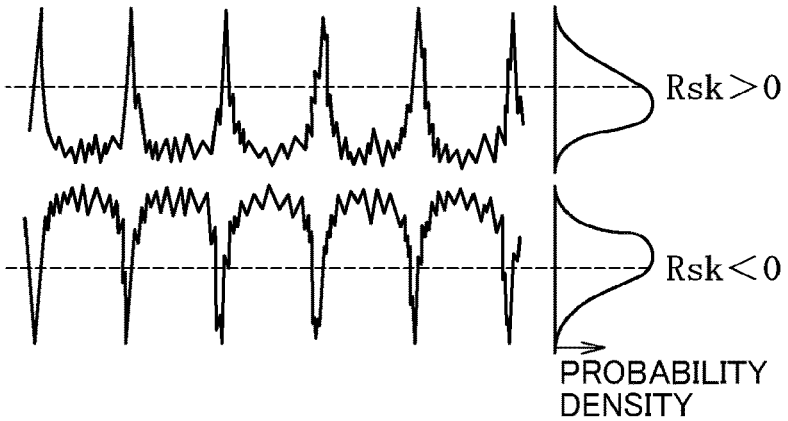
FIG. 11 is a diagram illustrating skewness of a roughness curve.

As illustrated in FIG. 11, if the skewness (Rsk) of the roughness curve is greater than zero (Rsk>0), the roughness curve is biased downward from an average line indicated with a dotted line in FIG. 11. Conversely, if the skewness (Rsk) of the roughness curve is smaller than zero (Rsk<0), the roughness curve is biased upward from the average line indicated with the dotted line in FIG. 11.

The kurtosis (Rku) of the roughness curve is another index for the surface roughness defined by JIS B0601-2013, 4.2.4 of the Japanese Industrial Standards. The kurtosis (Rku) of the roughness curve indicates a degree of peakedness or sharpness of a height distribution of surface roughness. The kurtosis (Rku) of the roughness curve is calculated with the fourth power mean of z(x) in a non-dimensional reference length obtained by raising a root-mean-square roughness (Rq) of a cross-sectional curve to the fourth power according to a formula (3) below.

Formula (3)

$$Rku = \frac{1}{Rq^4}\left[\frac{1}{\ell}\int_0^{\ell} z^4(x)dx\right] \quad (3)$$

Figure 12:
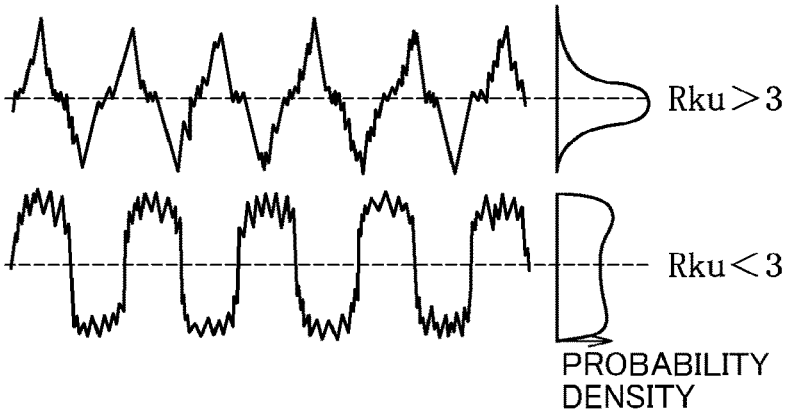
FIG. 12 is a diagram illustrating kurtosis of the roughness curve.

As illustrated in FIG. 12, if the kurtosis (Rku) of the roughness curve is greater than 3 (Rku>3), the height distribution of surface roughness creates crests and troughs that project sharply. Conversely, if the kurtosis (Rku) of the roughness curve is smaller than 3 (Rku<3), the height distribution of surface roughness creates crests and troughs that are flattened.

Like measurement of the ten-point average roughness (Rz), the skewness (Rsk) of the roughness curve and the kurtosis (Rku) of the roughness curve were measured by the method conforming to JIS B0601-2001 of the Japanese Industrial Standards under the evaluation length (Ln) of 1.5 mm, the reference length (L) of 0.25 mm, and the cutoff value of 0.8 mm with the surface roughness meter, SURFCOM 1400A available from TOKYO SEIMITSU CO., LTD.

A test was performed with fixing devices installed with the fixing belt and the heaters as the samples that were prepared as described above. As a lubricant, silicone oil having a kinetic viscosity of 150 $mm^2$/sec was interposed between each of the heaters and the fixing belt. In a state in which a surface temperature of the fixing belt in each of the fixing devices was 140 degrees Celsius, 300,000 sheets in total of A4 size sheets as plain paper in landscape orientation were conveyed such that 500 sheets as a batch were conveyed continuously at a conveyance speed of 150 mm/sec. Evaluation was performed on generation of noise due to stick-slip, a rotation torque of the fixing belt, and a temperature increase time taken to increase the surface temperature of the fixing belt from 30 degrees Celsius to 140 degrees Celsius. Table 1 below illustrates results of the test. The following describes evaluation criteria for evaluation items.

[Evaluation Criteria for Generation of Noise and the Rotation Torque of the Fixing Belt]

D: Noise generated before conveyance of 300,000 sheets finished or the rotation torque of the fixing belt exceeded 1.0 Nm.

B: Noise did not generate until conveyance of 300,000 sheets finished and the rotation torque of the fixing belt was 1.0 Nm or smaller but exceeded 0.6 Nm.

A: Noise did not generate until conveyance of 300,000 sheets finished and the rotation torque of the fixing belt was 0.6 Nm or smaller.

[Evaluation Criteria for the Temperature Increase Time]

D: The temperature increase time taken to increase the surface temperature of the fixing belt from 30 degrees Celsius to 140 degrees Celsius was longer than 5 seconds.

C: The temperature increase time taken to increase the surface temperature of the fixing belt from 30 degrees Celsius to 140 degrees Celsius was longer than 4 seconds and not longer than 5 seconds.

B: The temperature increase time taken to increase the surface temperature of the fixing belt from 30 degrees Celsius to 140 degrees Celsius was not shorter than 3 seconds and not longer than 4 seconds.

A: The temperature increase time taken to increase the surface temperature of the fixing belt from 30 degrees Celsius to 140 degrees Celsius was shorter than 3 seconds.

TABLE 1

| | Ten-point average roughness (Rz) [μm] | Skewness (Rsk) of roughness curve [μm] | Kurtosis (Rku) of roughness curve [μm] | Generation of noise Rotation torque | Temperature increase time |
|---|---|---|---|---|---|
| Comparative Example 1 | 0.311 | 1.213 | 4.198 | D | B |
| Embodiment 1 | 30.252 | 2.015 | 3.451 | B | C |
| Embodiment 2 | 17.524 | 0.112 | 4.313 | B | B |
| Embodiment 3 | 10.296 | −0.679 | 3.451 | B | A |
| Embodiment 4 | 7.403 | −1.359 | 2.895 | A | A |

As illustrated in Table 1, according to Comparative Example 1, contrarily to other Embodiments 1 to 4, the ten-point average roughness of the slide layer of the heater was 0.311 μm that was smaller than 1.5 μm of the ten-point average roughness of the inner circumferential surface of the fixing belt. For example, according to Comparative Example 1, the inner circumferential surface of the fixing belt was rougher than the slide layer of the heater. According to Comparative Example 1, when about 20,000 sheets were conveyed, noise due to stick-slip generated, obtaining evaluation rank D as illustrated in Table 1.

Conversely, according to Embodiments 1 to 4, noise due to stick-slip did not generate. Additionally, the rotation torque of the fixing belt did not exceed 1.0 Nm. For example, according to Embodiment 4, the rotation torque of the fixing belt was 0.6 Nm or smaller, obtaining evaluation rank A as illustrated in Table 1. It is assumed that, according to Embodiment 4, unlike other Embodiments 1 to 3, the kurtosis (Rku) of the roughness curve was smaller than 3 μm. For example, if the kurtosis (Rku) of the roughness curve was smaller than 3 μm, a surface (e.g., a slide face) of the slide layer of the heater had a decreased sharpness as illustrated in a lower part in FIG. 12. Accordingly, the slide layer was not subject to abrasion, retaining a decreased rotation torque.

Like Embodiments 3 and 4, if the skewness (Rsk) of the roughness curve was smaller than zero, the temperature increase time of the fixing belt was short, for example, shorter than 3 seconds, obtaining evaluation rank A as illustrated in Table 1. It is assumed that, if the skewness (Rsk) of the roughness curve was smaller than zero, the roughness curve had a substantial number of small crests as illustrated in a lower part in FIG. 11. Hence, the slide layer of the heater contacted the fixing belt with an increased contact area, improving efficiency in conduction of heat from the slide layer of the heater to the fixing belt. Additionally, if the skewness (Rsk) of the roughness curve was smaller than zero, a lubricant interposed between the fixing belt and the slide layer of the heater in the small crests of the roughness curve had a decreased film thickness. Hence, it is assumed that the lubricant suppressed resistance against conduction of heat, improving efficiency in conduction of heat from the heater to the fixing belt and thereby shortening the temperature increase time of the fixing belt. Conversely, according to Embodiment 1, the skewness (Rsk) of the roughness curve was greater than zero. Additionally, the ten-point average roughness (Rz) was also greater than that according to each of other Embodiments 2 to 4. Hence, it is assumed that the fixing belt contacted the heater with a decreased contact area and the lubricant held in the troughs of the roughness curve of the slide layer had an increased film thickness, thus increasing the temperature increase time of the fixing belt.

As described above, according to the results of the test, the slide face, that faces the fixing belt, of the slide layer of the heater is rougher than a sliding face, that faces the heater, of the fixing belt, thus suppressing noise caused by stick-slip. For example, noise caused by stick-slip generates easily if each of the sliding face of the fixing belt and the slide face of the heater is a mirror surface having a decreased surface roughness and therefore the sliding face of the fixing belt contacts the slide face of the heater with an increased adhesion. For example, if the slide face of the slide layer of the heater has a decreased surface roughness, the heater barely suppresses noise due to stick-slip advantageously. To address this circumstance, the slide face of the slide layer of the heater preferably has a ten-point average roughness (Rz) of 0.5 μm or greater and more preferably 3 μm or greater.

Conversely, if the slide face of the slide layer of the heater has an excessively increased surface roughness, the fixing belt contacts the heater with a decreased contact area, degrading conduction of heat from the heater to the fixing belt and therefore increasing the temperature increase time of the fixing belt. To address this circumstance, the slide face of the slide layer of the heater preferably has a ten-point average roughness (Rz) of 20 μm or smaller, like Embodiments 2 to 4. Thus, the slide face of the slide layer of the heater has the ten-point average roughness (Rz) of 20 μm or smaller, increasing the contact area where the fixing belt contacts the heater and improving efficiency in conduction of heat from the heater to the fixing belt. Further, in order to improve efficiency in conduction of heat from the heater to the fixing belt, the slide face of the slide layer of the heater preferably has a ten-point average roughness (Rz) of 10 μm or smaller.

Like Embodiments 3 and 4, the skewness (Rsk) of the roughness curve in the slide direction in which the fixing belt slides over the heater is smaller than zero, improving efficiency in conduction of heat from the heater to the fixing belt and shortening the temperature increase time of the fixing belt. Further, like Embodiment 4, the skewness (Rsk) of the roughness curve in the slide direction in which the fixing belt slides over the heater is preferably smaller than −1.

Like Embodiment 4, the kurtosis (Rku) of the roughness curve in the slide direction in which the fixing belt slides over the heater is smaller than 3, suppressing abrasion of the slide layer of the heater and decreasing the rotation torque of the fixing belt.

If the ten-point average roughness (Rz) and the skewness (Rsk) of the roughness curve of the slide layer 50 are set as described above, heat is conducted from the heater 22 to the fixing belt 20 effectively. Accordingly, the slide layer 50, for example, a rough portion of the slide layer 50, that is rougher than the inner circumferential surface of the fixing belt 20, is preferably greater than the length L2 of the heat generating span that defines the combined length of the length of one lateral end heat generator 60B, the length of the center heat generator 60A, and the length of another lateral end heat generator 60B in the longitudinal direction of the fixing belt 20 depicted in FIG. 2. Consequently, heat is conducted from the heater 22 to the fixing belt 20 properly throughout an entire span of the heat generator 60 in the longitudinal direction of the heater 22, improving energy saving and shortening a warm-up time of the fixing device 9 effectively. Additionally, since heat is conducted from the heater 22 to the fixing belt 20 effectively, the heater 22 having the PTC property according to the embodiments, for example, increases the speed at which the heater 22 heats the fixing belt 20 and suppresses overheating of the heater 22 and resultant thermal degradation of the heater 22, thus extending the life of the heater 22.

As the lubricant interposed between the slide layer 50 of the heater 22 and the fixing belt 20, oil not containing thickener (e.g., oil containing base oil and an additive) is more preferable than grease containing thickener. Oil has a film thickness that is smaller than a film thickness of grease, improving efficiency in conduction of heat from the heater 22 to the fixing belt 20. However, if oil has an increased kinetic viscosity, oil may increase the rotation torque of the fixing belt 20 or may have an increased film thickness, thus degrading efficiency in conduction of heat from the heater 22 to the fixing belt 20. Conversely, if oil has a decreased kinetic viscosity, the lubricant may generate a solid that renders the heater 22 and the fixing belt 20 to be subject to abrasion. To address this circumstance, oil has a kinetic viscosity not smaller than 100 $mm^2$/sec and not greater than 600 $mm^2$/sec preferably and a kinetic viscosity not smaller than 100 $mm^2$/sec and not greater than 300 $mm^2$/sec more preferably at 25 degrees Celsius. In the fixing device 9, when the temperature of the outer circumferential surface of the fixing belt 20 is about 140 degrees Celsius, the temperature of the inner circumferential surface of the fixing belt 20, that bears the lubricant, is about 150 degrees Celsius. Hence, heat resistant silicone oil or the like is preferably used as the lubricant.

As a method for roughening the slide face (e.g., the fixing belt side face 50*a*) of the slide layer 50 of the heater 22, sandblasting or the like that sprays abrasive grain onto the slide face is employed, for example. As another method, when forming the slide layer 50 of the heater 22, carbon fiber such as graphite and graphene may be added to fluororesin. In this case, since carbon fiber produces fine roughness on the slide face of the slide layer 50 of the heater 22, the fine roughness of carbon fiber adjusts the slide face of the slide layer 50 of the heater 22 to have a desired surface roughness. Additionally, the method that adds carbon fiber eliminates secondary processing such as blasting, simplifying manufacturing processes. Further, carbon fiber has an enhanced thermal conductivity, improving conduction of heat from the heater 22 to the fixing belt 20 advantageously.

The above describes the embodiments of the present disclosure. However, the technology of the present disclosure is not limited to the embodiments described above. For example, the heater according to the embodiments of the present disclosure may have any one of constructions illustrated in FIGS. 13, 14, and 15, respectively, other than the construction of the heater 22 depicted in FIG. 7.

Figure 13:
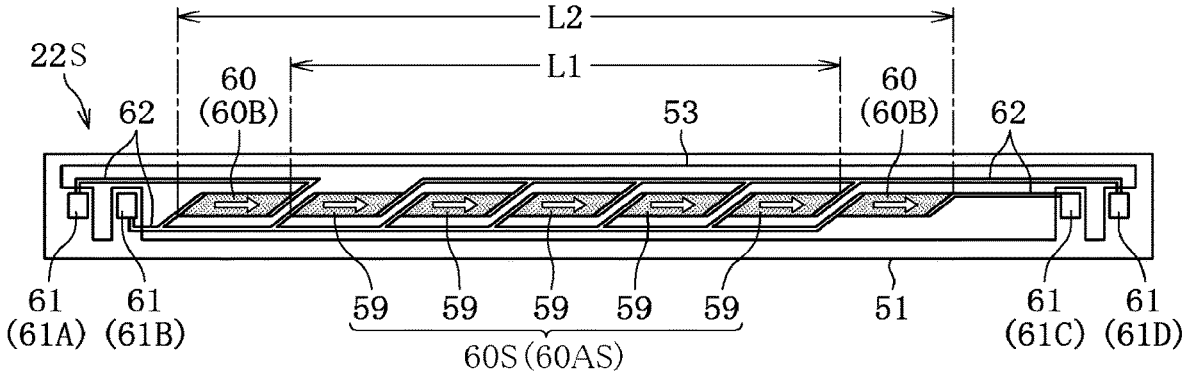
FIG. 13 is a plan view of a heater as a first variation of the heater depicted in FIG. 7.

FIG. 13 illustrates a heater 22S that includes a heat generator 60S as a center heat generator 60AS which is divided into a plurality of heat generating blocks 59 in a longitudinal direction of the center heat generator 60AS. The center heat generator 60AS is not constructed of a single elongate heat generating block and is divided into the plurality of short heat generating blocks 59. Accordingly, a length of each of the heat generating blocks 59 is equivalent to a length of the lateral end heat generator 60B in a longitudinal direction of the heater 22S. A resistance value of each of the heat generating blocks 59 is equivalent to a resistance value of the lateral end heat generator 60B. For example, the length L1 of the center heat generator 60AS is equivalent to a width of 215 mm of an A4 size sheet in portrait orientation. The length L2 of the heat generating span defines the combined length of the length of one lateral end heat generator 60B, a length of the center heat generator 60AS, and the length of another lateral end heat generator 60B in the longitudinal direction of the heater 22S. The length L2 may be equivalent to a width of 301 mm of an A3 size sheet in portrait orientation. In this case, as the center heat generator 60AS is divided into the five heat generating blocks 59, each of the heat generating blocks 59 and the lateral end heat generators 60B has an identical length of 43 mm in the longitudinal direction of the heater 22S. Accordingly, the resistance value of each of the heat generating blocks 59 is equivalent to the resistance value of each of the lateral end heat generators 60B, thus heating the fixing belt 20 evenly in the longitudinal direction thereof.

Figure 14:
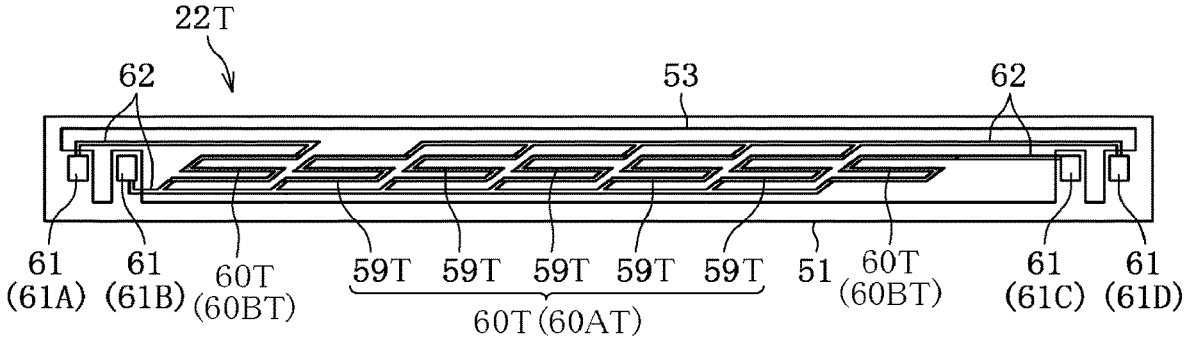
FIG. 14 is a plan view of a heater as a second variation of the heater depicted in FIG. 7.

FIG. 14 illustrates a heater 22T that includes heat generators 60T as a center heat generator 60AT and lateral end heat generators 60BT. The center heat generator 60AT is divided into a plurality of heat generating blocks 59T in a longitudinal direction of the center heat generator 60AT. Each of the heat generating blocks 59T and the lateral end heat generators 60BT is bent to produce a turned pattern. An electric current flows along the turned pattern.

Figure 15:
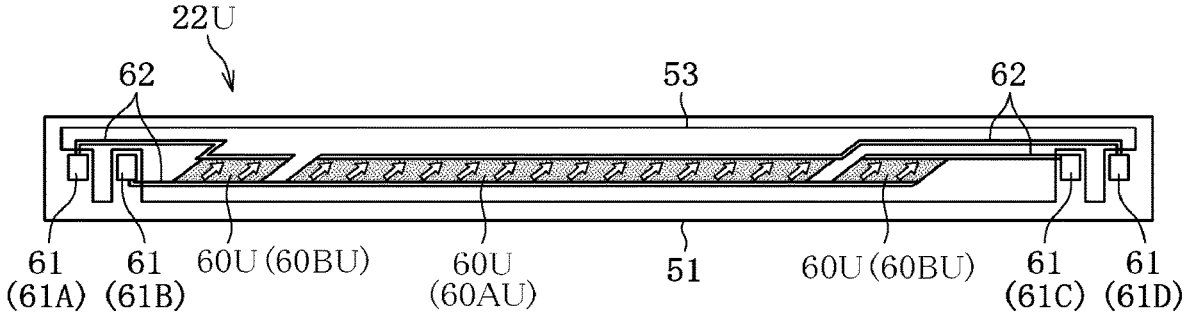
FIG. 15 is a plan view of a heater as a third variation of the heater depicted in FIG. 7.

FIG. 15 illustrates a heater 22U that includes heat generators 60U as a center heat generator 60AU and lateral end heat generators 60BU. Each of the center heat generator 60AU and the lateral end heat generators 60BU is coupled to the feeders 62 at both ends (e.g., an upper end and a lower end in FIG. 15) of each of the center heat generator 60AU and the lateral end heat generators 60BU in a short direction thereof, respectively. In this case, as illustrated with arrows in FIG. 15, the electric current flows in diagonal directions defined by longitudinal directions and the short directions of the center heat generator 60AU and the lateral end heat generators 60BU, respectively.

In the heaters 22, 22S, 22T, and 22U incorporating the plurality of heat generators, that is, the heat generators 60, 60S, 60T, and 60U, respectively, as described above, a gap between adjacent heat generators (e.g., the heat generators 60, 60S, 60T, and 60U) or a gap between adjacent heat generating blocks (e.g., the heat generating blocks 59 and 59T) is preferably 0.2 mm or greater and more preferably 0.4 mm or greater, in view of ensuring insulation therebetween. If the gap is excessively great, the gap is subject to temperature decrease. To address this circumstance, the gap is preferably 5 mm or smaller and more preferably 1 mm or smaller, in view of suppressing uneven temperature of the heaters 22, 22S, 22T, and 22U in a longitudinal direction thereof.

Application of the embodiments of the present disclosure is not limited to the heaters 22, 22S, 22T, and 22U each of which has the plurality of heat generators (e.g., the center heat generators 60A, 60AS, 60AT, and 60AU and the lateral end heat generators 60B, 60BT, and 60BU) described above, that is controlled separately from each other. Alternatively, the embodiments of the present disclosure are also applicable to a heater that incorporates a single heat generator.

The embodiments of the present disclosure are also applicable to fixing devices 9S, 9T, 9U, 9V, 9W, 9X, and 9Y illustrated in FIGS. 16 to 22, respectively, other than the fixing device 9 described above. The following briefly describes a construction of each of the fixing devices 9S, 9T, 9U, 9V, 9W, 9X, and 9Y illustrated in FIGS. 16 to 22, respectively.

Figure 16:
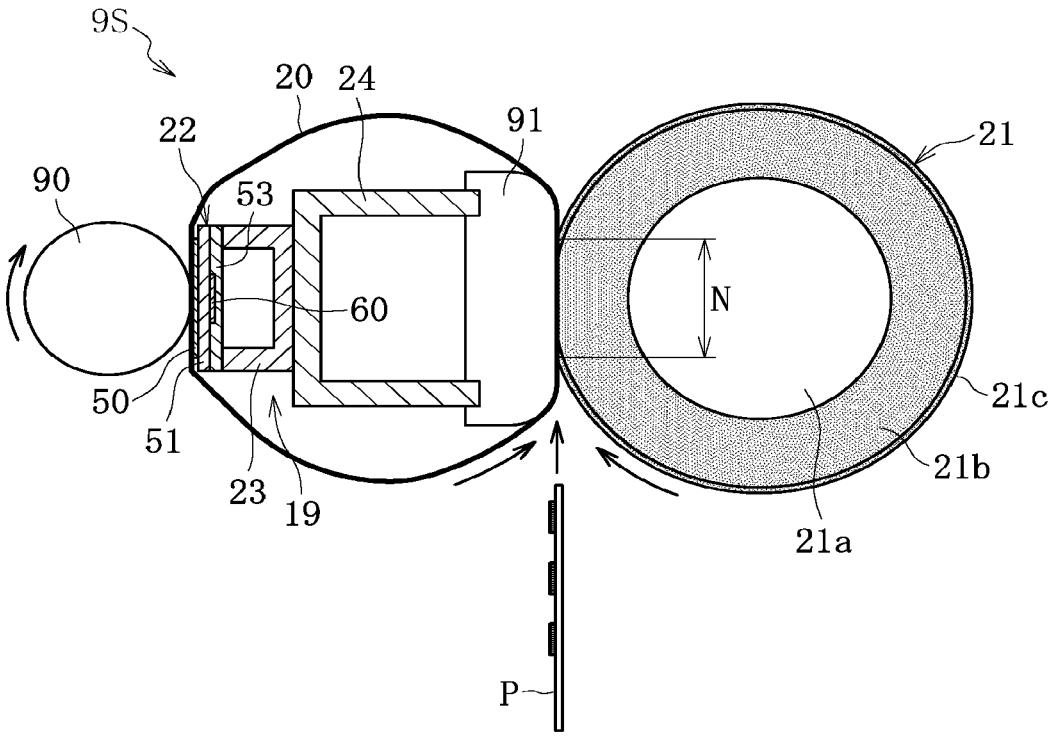
FIG. 16 is a schematic cross-sectional view of a fixing device as a first variation of the fixing device depicted in FIG. 2.

FIG. 16 illustrates the fixing device 9S that includes a pressing roller 90 disposed opposite the pressure roller 21 via the fixing belt 20. The pressing roller 90 and the heater 22 sandwich the fixing belt 20 so that the heater 22 heats the fixing belt 20. On the other hand, a nip former 91 (e.g., a nip forming pad) is in contact with the inner circumferential surface of the fixing belt 20 and disposed opposite the pressure roller 21 via the fixing belt 20. The stay 24 supports the nip former 91. The nip former 91 and the pressure roller 21 sandwich the fixing belt 20 and define the fixing nip N.

Figure 17:
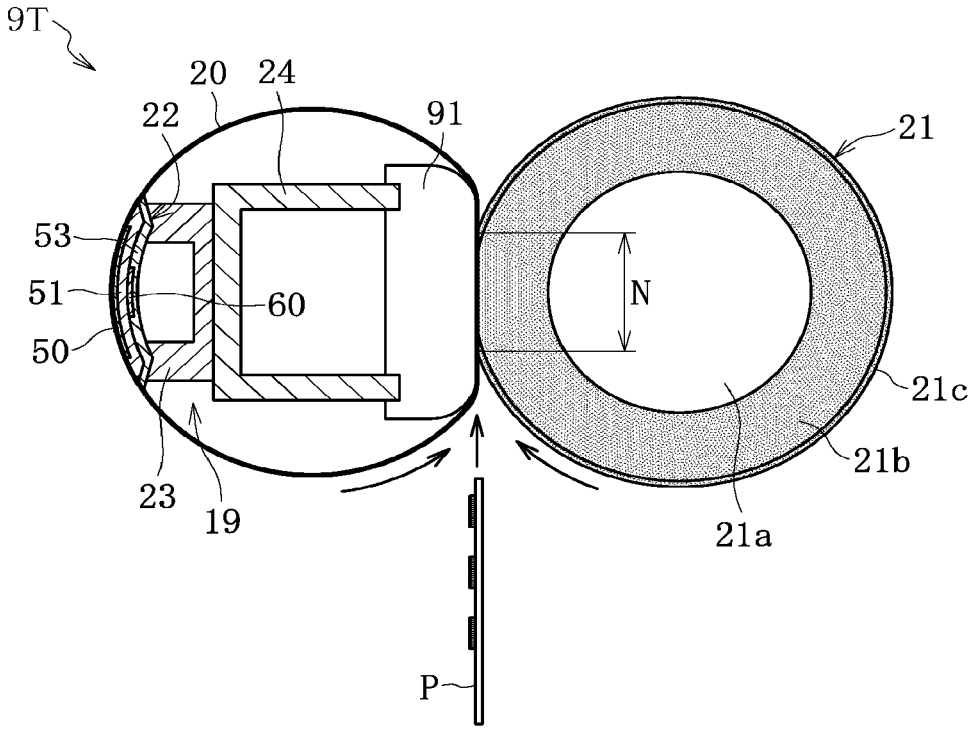
FIG. 17 is a schematic cross-sectional view of a fixing device as a second variation of the fixing device depicted in FIG. 2.

FIG. 17 illustrates the fixing device 9T that does not incorporate the pressing roller 90 described above with reference to FIG. 16. In order to attain a contact length for which the heater 22 contacts the fixing belt 20 in the circumferential direction thereof, the heater 22 is curved into an arc in cross section that corresponds to a curvature of the fixing belt 20. Other construction of the fixing device 9T is equivalent to that of the fixing device 9S depicted in FIG. 16.

Figure 18:
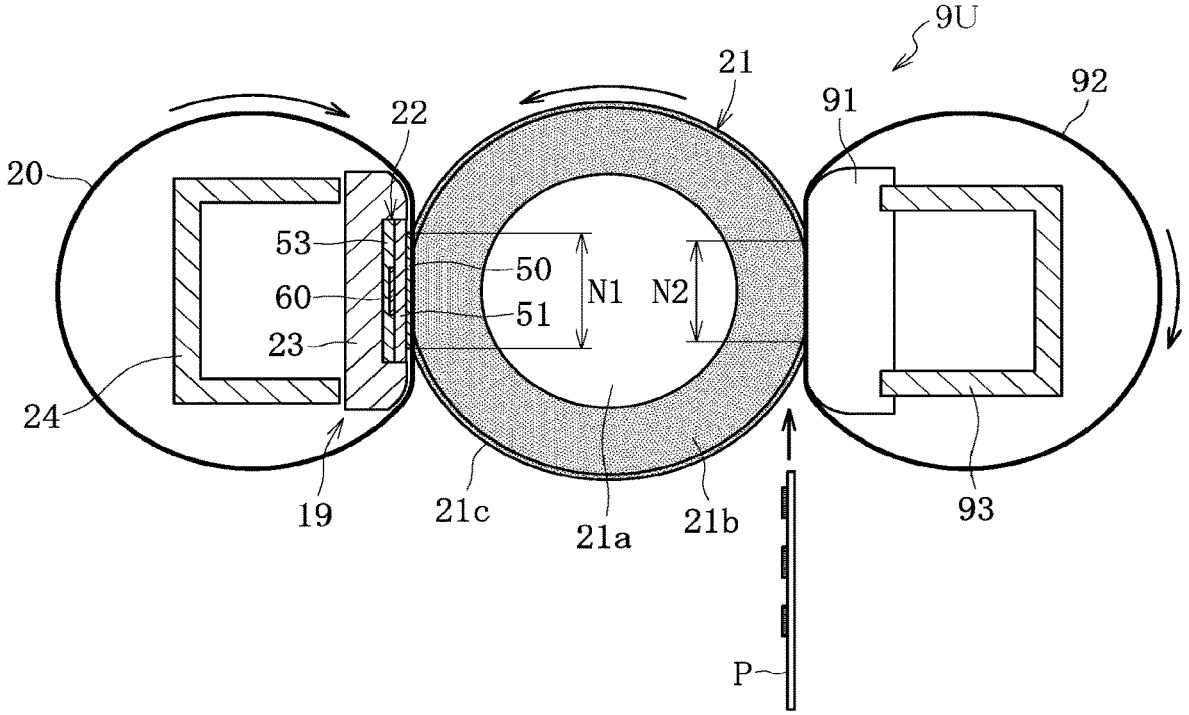
FIG. 18 is a schematic cross-sectional view of a fixing device as a third variation of the fixing device depicted in FIG. 2.

FIG. 18 illustrates the fixing device 9U that includes a pressure belt 92 in addition to the fixing belt 20. The pressure belt 92 and the pressure roller 21 form a fixing nip N2 serving as a secondary nip separately from a heating nip N1 serving as a primary nip formed between the fixing belt 20 and the pressure roller 21. For example, the nip former 91 and a stay 93 are disposed opposite the fixing belt 20 via the pressure roller 21. The pressure belt 92 that is rotatable accommodates the nip former 91 and the stay 93. As a sheet P bearing a toner image is conveyed through the fixing nip N2 formed between the pressure belt 92 and the pressure roller 21, the pressure belt 92 and the pressure roller 21 fix the toner image on the sheet P under heat and pressure. Other construction of the fixing device 9U is equivalent to that of the fixing device 9 depicted in FIG. 2.

Figure 19:
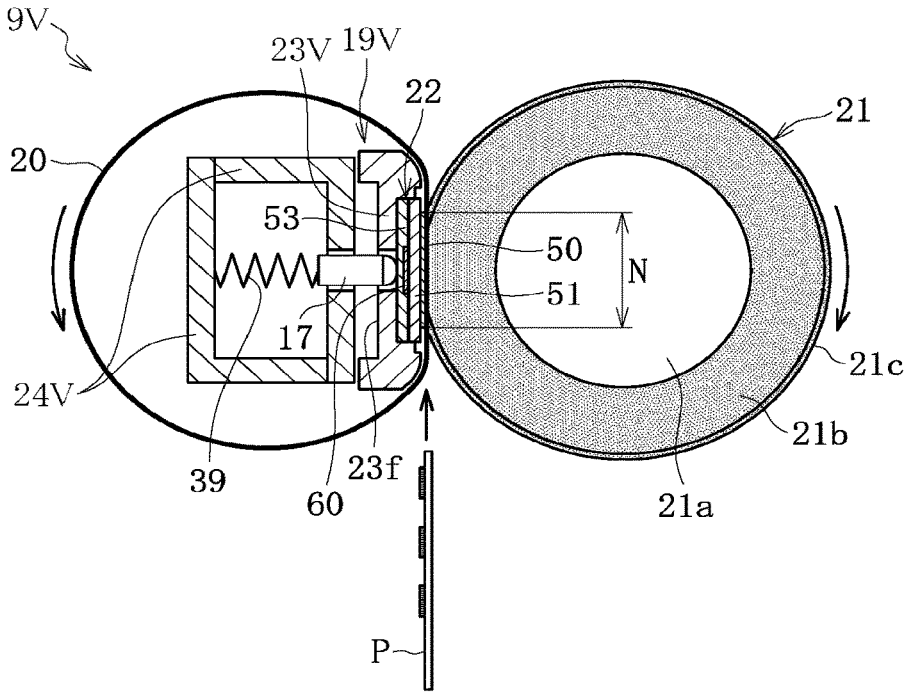
FIG. 19 is a schematic cross-sectional view of a fixing device as a fourth variation of the fixing device depicted in FIG. 2.

FIG. 19 illustrates the fixing device 9V including a heating device 19V that includes a stay 24V constructed of two L-shaped portions in cross section that are joined by caulking, welding, screwing, or the like. A recess 23*f* is disposed on a stay side face of a heater holder 23V, that faces the stay 24V. The recess 23*f* causes the heater holder 23V to be separated from the stay 24V at a portion of the heater holder 23V, that is provided with the recess 23*f*. Accordingly, the recess 23*f* decreases conduction of heat from the heater holder 23V to the stay 24V. Other construction of the fixing device 9V is equivalent to that of the fixing device 9 depicted in FIG. 2.

Figure 20:
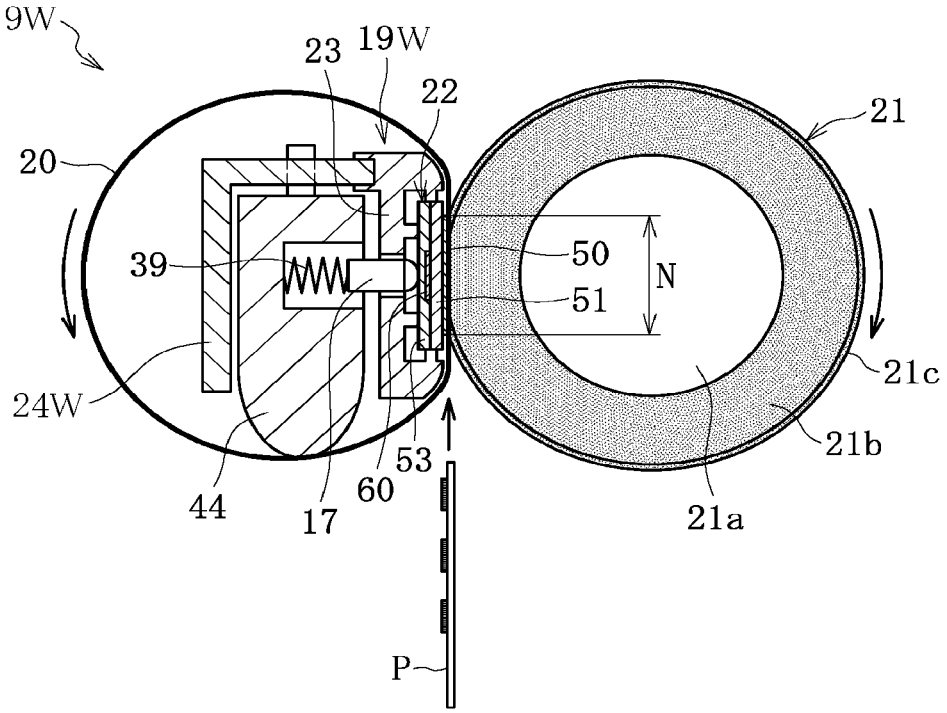
FIG. 20 is a schematic cross-sectional view of a fixing device as a fifth variation of the fixing device depicted in FIG. 2.

FIG. 20 illustrates the fixing device 9W including a heating device 19W that includes a stay 24W constructed of a single L-shaped portion in cross section that is cantilevered by the heater holder 23. The stay 24W mounts a belt guide 44 that contacts the inner circumferential surface of the fixing belt 20 and guides the fixing belt 20. In an example depicted in FIG. 20, the belt guide 44 contacts the fixing belt 20 at an upstream position disposed upstream from the fixing nip N in the rotation direction of the fixing belt 20. The belt guide 44 also serves as a support that supports a coil spring 39 that brings the thermistor 17 into contact with the heater 22. For example, the belt guide 44 is preferably made of a resin material that improves heat resistance, such as LCP. Other construction of the fixing device 9W is equivalent to that of the fixing device 9 depicted in FIG. 2.

Figure 21:
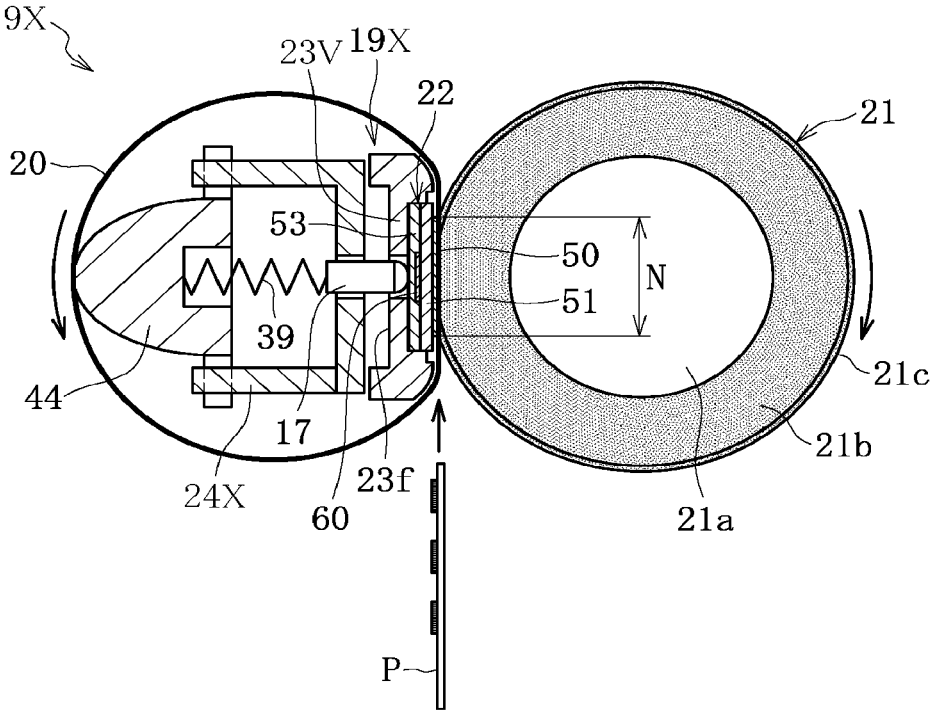
FIG. 21 is a schematic cross-sectional view of a fixing device as a sixth variation of the fixing device depicted in FIG. 2.

FIG. 21 illustrates the fixing device 9X including a heating device 19X that includes a stay 24X inverted horizontally in FIG. 21 from an orientation of the stay 24 depicted in FIG. 2. In the fixing device 9X, the belt guide 44 contacts the fixing belt 20 at a position disposed opposite the fixing nip N via the stay 24X, the heater holder 23V, and the heater 22. Like the belt guide 44 depicted in FIG. 20, the belt guide 44 depicted in FIG. 21 also serves as a support that supports the coil spring 39. Additionally, in the fixing device 9X depicted in FIG. 21, like the fixing device 9V depicted in FIG. 19, the recess 23*f* is disposed on the stay side face of the heater holder 23V, that faces the stay 24X. Accordingly, the recess 23*f* decreases conduction of heat from the heater holder 23V to the stay 24X. Other construction of the fixing device 9X is equivalent to that of the fixing device 9 depicted in FIG. 2.

Figure 22:
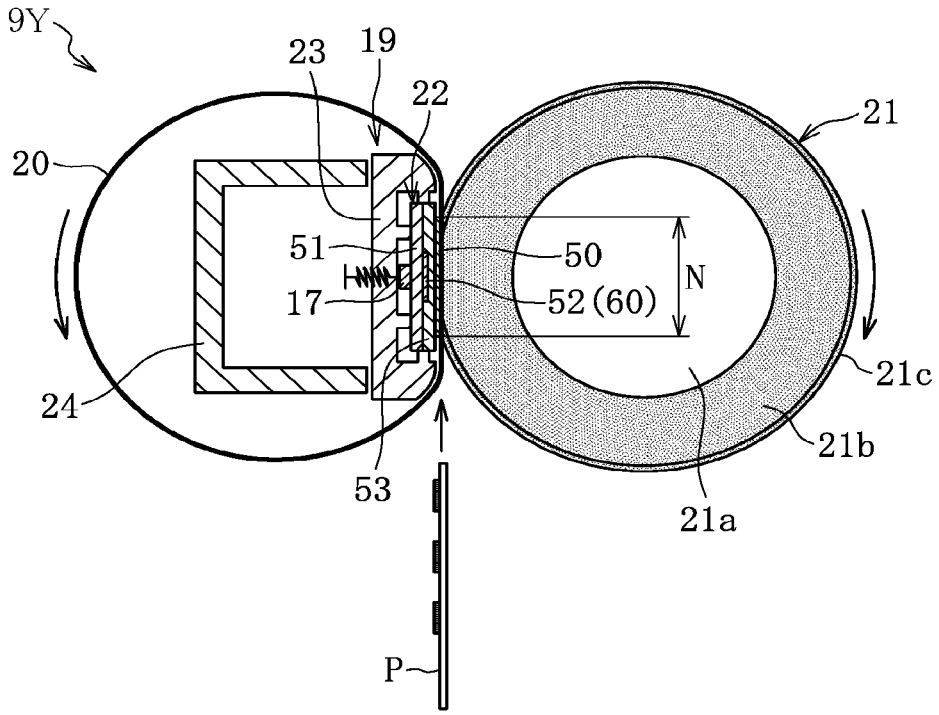
FIG. 22 is a schematic cross-sectional view of a fixing device as a seventh variation of the fixing device depicted in FIG. 2.

FIG. 22 illustrates the fixing device 9Y that includes the heat generators 60 disposed opposite the fixing belt 20, unlike the heat generators 60 of the fixing devices 9, 9S, 9T, 9U, 9V, 9W, and 9X. For example, in the fixing device 9Y depicted in FIG. 22, the conductor layer 52 including the heat generators 60, the insulating layer 53, and the slide layer 50 are layered on the base layer 51 successively in this order on the fixing belt side face of the base layer 51. Since heat generated by the heat generators 60 is conducted to the fixing belt 20 through the insulating layer 53 and the slide layer 50, the insulating layer 53 and the slide layer 50 are preferably made of a material having an increased thermal conductivity.

Figure 23:
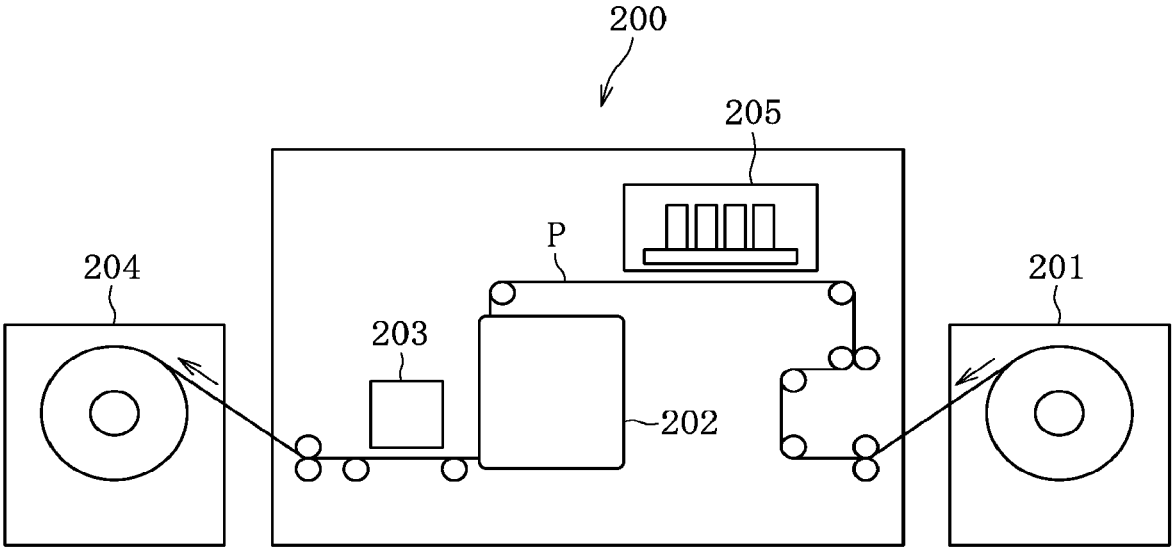
FIG. 23 is a schematic cross-sectional view of an inkjet image forming apparatus incorporating a dryer according to an embodiment of the present disclosure.

The heaters 22, 22S, 22T, and 22U according to the embodiments of the present disclosure are also applicable to devices other than the fixing devices 9, 9S, 9T, 9U, 9V, 9W, 9X, and 9Y installed in the image forming apparatus 100 employing an electrophotographic method. For example, the heaters 22, 22S, 22T, and 22U according to the embodiments of the present disclosure are also applicable to a dryer installed in an image forming apparatus 200 employing an inkjet method as illustrated in FIG. 23. FIG. 23 illustrates the image forming apparatus 200 employing the inkjet method. The image forming apparatus 200 includes an inkjet image forming device 205, a sheet feeding device 201, a dryer 202, an inspection device 203, and a sheet ejection device 204. The inkjet image forming device 205 ejects ink onto a sheet P to form an image on the sheet P. The sheet feeding device 201 supplies the sheet P to the inkjet image forming device 205. The dryer 202 dries ink of the image on the sheet P. The inspection device 203 inspects whether the image is stained or spotted, for example. The sheet ejection device 204 winds up the sheet P bearing the image into a roll. The dryer 202 installed in the image forming apparatus 200 using the inkjet method employs the heater 22, 22S, 22T, or 22U according to the embodiments of the present disclosure. Accordingly, the dryer 202 suppresses noise caused by stick-slip between a heater (e.g., the heater 22, 22S, 22T, or 22U) and a counterpart (e.g., the fixing belt 20) that slides over the heater.

The heater (e.g., the heaters 22, 22S, 22T, and 22U) according to the embodiments of the present disclosure is installed in a fixing device (e.g., the fixing devices 9, 9S, 9T, 9U, 9V, 9W, 9X, and 9Y) or a dryer (e.g., the dryer 202) installed in an image forming apparatus (e.g., the image forming apparatuses 100 and 200). Alternatively, the heater according to the embodiments of the present disclosure may be applied to a coater (e.g., a laminator) or the like that laminates and thermally presses film as a coating member onto a surface of a sheet.

According to the embodiments described above, a belt (e.g., the fixing belt 20) slides over the heater. Alternatively, a counterpart other than the belt may slide over the heater relatively.

A description is provided of advantages of a heater (e.g., the heaters 22, 22S, 22T, and 22U).

As illustrated in FIGS. 2 and 10, the heater includes a base layer (e.g., the base layer 51), a heat generator (e.g., the heat generator 60), and a slide layer (e.g., the slide layer 50). The heat generator is mounted on the base layer. The slide layer is mounted on the base layer. A counterpart (e.g., the fixing belt 20) slides over the slide layer. The slide layer is made of a material containing fluorine. The slide layer includes a slide face (e.g., the fixing belt side face 50*a*) that contacts the counterpart. The counterpart includes a sliding face (e.g., the heater side face 20*a*) that contacts and slides over the slide face of the slide layer. A surface roughness of the slide face of the slide layer is greater than a surface roughness of the sliding face of the counterpart.

Accordingly, the heater suppresses noise caused by stick-slip between the heater and the counterpart that slides over the heater.

According to the embodiments described above, the fixing belt 20 serves as an endless belt. Alternatively, a fixing film, a fixing sleeve, or the like may be used as an endless belt. Further, the pressure roller 21 serves as an opposed rotator. Alternatively, a pressure belt or the like may be used as an opposed rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A heater over which a sliding face of a counterpart is configured to slide; the heater comprising:
   - a base layer;
   - a heat generator mounted on a first side of the base layer and configured to heat the counterpart; and
   - a slide layer mounted on a second side of the base layer opposite from the first side, the slide layer over which the counterpart slides, the slide layer being made of a material containing fluorine, the slide layer including a slide face configured to contact the sliding face of the counterpart, the slide face of the slide layer of the heater having a surface roughness that is greater than a surface roughness of the sliding face of the counterpart.

2. The heater according to claim 1, wherein the surface roughness defines a ten-point average roughness.

3. The heater according to claim 2, wherein the ten-point average roughness of the slide face of the slide layer is not smaller than 0.5 μm and not greater than 20 μm.

4. The heater according to claim 1, wherein the slide face of the slide layer has a skewness of a roughness curve in a slide direction in which the counterpart slides over the slide face of the slide layer, the skewness that is smaller than zero.

5. The heater according to claim 1, wherein the slide face of the slide layer has a skewness of a roughness curve in a slide direction in which the counterpart slides over the slide face of the slide layer, the skewness that is smaller than −1.

6. The heater according to claim 1, wherein the slide face of the slide layer has a kurtosis of a roughness curve in a slide direction in which the counterpart slides over the slide face of the slide layer, the kurtosis that is smaller than 3.

7. The heater according to claim 1, wherein the material containing fluorine has a cross-linked structure.

8. The heater according to claim 1, wherein the slide layer is made of a material containing carbon fiber, and wherein the slide face of the slide layer has fine roughness made of the carbon fiber.

9. The heater according to claim 1, wherein the heat generator has a positive temperature coefficient of resistance in a range of from 200 ppm/° C. to 4,000 ppm/° C.

10. A heating device comprising:

a counterpart including a sliding face; and a heater configured to heat the counterpart, the heater including:

a base layer;

a heat generator mounted on a first side of the base layer and configured to heat the counterpart; and a slide layer mounted on a second side of the base layer opposite from the first side, the slide layer over which the sliding face of the counterpart slides, the slide layer being made of a material containing fluorine, the slide layer including a slide face configured to contact the sliding face of the counterpart, the slide face of the slide layer of the heater having a surface roughness that is greater than a surface roughness of the sliding face of the counterpart.

11. The heating device according to claim 10, wherein a lubricant is interposed between the slide layer of the heater and the counterpart.

12. The heating device according to claim 11, wherein the lubricant includes oil not containing thickener.

13. The heating device according to claim 12, wherein the lubricant includes silicone oil having a kinetic viscosity not smaller than 100 mm2/sec and not greater than 600 mm2/sec at 25 degrees Celsius.

14. The heating device according to claim 10, wherein the surface roughness defines a ten-point average roughness.

15. The heating device according to claim 14, wherein the ten-point average roughness of the sliding face of the counterpart is not greater than 5.5 μm.

16. The heating device according to claim 10, wherein the counterpart includes an endless belt and the slide layer is independent of a heater holder that holds the heater.

17. A fixing device comprising the heating device according to claim 10.

18. The fixing device according to claim 17, wherein the counterpart includes an endless belt configured to rotate, the endless belt configured to be contacted and heated by the heater.

19. The fixing device according to claim 18, further comprising an opposed rotator configured to contact an outer circumferential surface of the endless belt to form a nip between the endless belt and the opposed rotator.

20. An image forming apparatus, comprising:

an image forming device configured to form an image;

a counterpart including a sliding face; and a heater configured to heat the counterpart, the heater including:

a base layer;

a heat generator mounted on a first side of the base layer and configured to heat the counterpart; and a slide layer mounted on a second side of the base layer opposite from the first side, the slide layer over which the sliding face of the counterpart slides, the slide layer being made of a material containing fluorine, the slide layer including a slide face configured to contact the sliding face of the counterpart, the slide face having a surface roughness that is greater than a surface roughness of the sliding face of the counterpart.

* * * * *